US007277091B2

(12) United States Patent
Ishii

(10) Patent No.: US 7,277,091 B2
(45) Date of Patent: Oct. 2, 2007

(54) DRIVING CIRCUIT FOR ELECTRO-OPTICAL PANEL, ELECTRO-OPTICAL DEVICE HAVING THE DRIVING CIRCUIT, AND ELECTRONIC APPARATUS HAVING THE ELECTRO-OPTICAL DEVICE

(75) Inventor: Kenya Ishii, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 675 days.

(21) Appl. No.: 10/831,205

(22) Filed: Apr. 26, 2004

(65) Prior Publication Data

US 2004/0257351 A1 Dec. 23, 2004

(30) Foreign Application Priority Data

May 12, 2003 (JP) ..... 2003-133279

(51) Int. Cl.
*G09G 5/00* (2006.01)

(52) U.S. Cl. ..... 345/204; 345/87

(58) Field of Classification Search ..... 345/87–100, 345/204

See application file for complete search history.

(56) References Cited

U.S. PATENT DOCUMENTS 5,686,936 A 11/1997 Maekawa et al.
5,959,600 A 9/1999 Uchino et al.
6,307,681 B1 * 10/2001 Aoki et al. ..... 359/645

FOREIGN PATENT DOCUMENTS

| | | |
|---|---|---|
| JP | A 07-295520 | 11/1995 |
| JP | A 8-286639 | 11/1996 |
| JP | A 11-218738 | 8/1999 |
| JP | 2000-206491 | 7/2000 |
| JP | A 2001-166744 | 6/2001 |

* cited by examiner

*Primary Examiner*—Richard Hjerpe
*Assistant Examiner*—Jean Lesperance
(74) *Attorney, Agent, or Firm*—Oliff & Berridge, PLC

(57) ABSTRACT

A driving circuit of an electro-optical panel includes a shift register circuit to sequentially output transmission signals, a sampling circuit to sample an image signal by using a sequentially-output n-th (n is a natural number greater than or equal to 2) transmission signal as a sampling-circuit driving signal and writing the sampled image signal to data lines, and a precharge circuit to write a precharge signal of a predetermined potential to the data lines prior to supplying the image signal to the data lines by using a sequentially-output (n−1)-th transmission signal as a precharge-circuit driving signal, all of which are formed on a substrate.

13 Claims, 13 Drawing Sheets

DRIVING CIRCUIT FOR ELECTRO-OPTICAL PANEL, ELECTRO-OPTICAL DEVICE HAVING THE DRIVING CIRCUIT, AND ELECTRONIC APPARATUS HAVING THE ELECTRO-OPTICAL DEVICE

BACKGROUND OF THE INVENTION

1. Field of Invention

The present invention relates to a driving circuit to drive an electro-optical panel, such as a liquid crystal panel, etc., an electro-optical device, such as a liquid crystal display device, etc. including the electro-optical panel and the driving circuit, and an electronic apparatus, such as a liquid crystal projector, etc. including the electro-optical device.

2. Description of Related Art

Related art examples of such driving units for an electro-optical panel include a data line driving circuit to drive data lines of the electro-optical panel, a sampling circuit, a precharge circuit, and others. The data line driving circuit outputs sequential transmission signals output from a shift register circuit thereof as sampling pulses to the sampling circuit. In response to the sampling pulses, the sampling circuit samples image signals of image signal lines and supplies the sampled image signals to the data lines.

The writing of image signals to the data lines by means of the sampling circuit causes no problem in electro-optical panels having low driving frequencies and employing an active matrix driving method. However, when the image fineness is enhanced or the driving frequency is raised due to a general requirement for excellent display quality, influence of wire capacity of the data lines, etc. cannot be neglected. Specifically, with the raising of the driving frequency, lack of driving ability of the data line driving circuit or lack of writing ability of the sampling circuit is elicited. Such lack of writing ability, etc. causes image defects, such as ghosts, etc.

For this reason, in the related art, the lack of driving ability of the data-line driving circuit or the lack of writing ability of the sampling circuit was compensated for, by writing a precharge signal of a predetermined potential level, for example, corresponding to a gray color or an intermediate color to the data lines before writing image signals to the data lines.

In order to lower the driving frequency or reduce a fly-back period, for example, for image display corresponding to a high vision the driving frequency of which is high and the fly-back period of which is short, a precharge circuit called a transmission precharge or sequential precharge circuit has been developed. According to such a transmission precharge circuit, right before writing the image signals to the data lines, by performing the sequential operation of the precharge circuit prior to the sequential operation of the sampling circuit, the precharge can be efficiently performed for a relatively short time.

In the related art transmission precharge circuit, on a substrate, a sampling circuit and a data-line driving circuit including a shift register circuit to drive the sampling circuit are arranged at one end of the data lines, and a precharge circuit and a precharge-circuit driving circuit including a shift register circuit to drive the precharge circuit are arranged at the other end of the data lines. In peripheral areas around an image display area in which the data lines are arranged on the substrate, the sampling circuit and the data-line driving circuit to drive the sampling circuit are arranged, for example, in the vicinity of the lower side of the image display area, and the precharge circuit and the precharge-circuit driving circuit to drive the precharge circuit are arranged, for example, in the vicinity of the upper side of the image display area. For this reason, a technical problem that it is very difficult to miniaturize a substrate or the whole device is basically caused due to employing the precharge circuit. Specifically, since separate circuits are provided at both ends of the data lines, arrangement of various wires on the substrate becomes difficult. Even when the various circuits are constructed as external IC circuits, problems, such as increase of the number of ICs, difficulty in securing mount areas, difficulty in manufacturing processes, etc. are caused.

SUMMARY OF THE INVENTION

The present invention is contrived to address the above problems. Thus the present invention provides a driving circuit for an electro-optical panel capable of performing the transmission precharge or sequential precharge with accomplishing miniaturization of, for example, a substrate or device or simplifying a device construction or a control condition on a substrate, an electro-optical device including the driving circuit and the electro-optical panel, and an electronic apparatus including the electro-optical device.

In order to accomplish the above an aspect of, the present invention provides a driving circuit for an electro-optical panel, including: pixel electrodes formed on a substrate; switching elements to switch and control the pixel electrodes; data lines to supply an image signal to the pixel electrodes through the switching elements; a data-line driving circuit including a shift register circuit that sequentially outputs transmission signals; a sampling circuit that samples the image signal using the sequentially-output n-th (n is a natural number greater than or equal to 2) transmission signal as a sampling-circuit driving signal, and writes the sampled image signal to the data lines; and a precharge circuit that writes a precharge signal of a predetermined potential to the data lines using the sequentially-output (n−1)-th transmission signal as a precharge-circuit driving signal prior to supplying the image signal to the data lines.

In the driving circuit for an electro-optical panel according to an aspect of the present invention, the image signal is sampled by the sampling circuit in response to the sampling pulse output from the data-line driving circuit during its operation. As a result, the sampled image signal is supplied to the data lines. Then, in the electro-optical panel, the image signal supplied through the data lines is supplied to the pixel electrodes through the switching elements including a thin film transistor (hereinafter, "TFT") in response to the scanning signal supplied through, for example, separate scanning lines. As a result, an image can be displayed using an active matrix driving method. During the operation, the precharge signal is written to the data lines by the precharge circuit prior to the supply of the image signal to the data lines by the sampling circuit. Therefore, the lack of writing ability of the image signal to the data lines causes no problem substantially or practically. By the image signal written with the relatively sufficient writing ability, it is possible to display images having excellent display quality with reduced ghost, etc.

Here, in the driving circuit for an electro-optical panel according to an aspect of the present invention, specifically, the sampling circuit and the precharge circuit operate using the transmission signals output from the same data-line driving circuit as the sampling-circuit driving signal and the precharge-circuit driving signal, respectively. The transmission precharge or sequential precharge can be performed using the transmission signal output from the same data-line driving circuit. In addition, unlike the related art driving circuit of the transmission precharge or sequential precharge type described above, it is not necessary to separately provide an exclusive circuit (that is, a data-line driving circuit) to sequentially drive the sampling circuit and an exclusive circuit (that is, a precharge-circuit driving circuit) to sequentially drive the precharge circuit, each of which has a shift register, respectively, on the substrate. Therefore, it is not necessary to construct individual circuits at both ends of the data lines in the peripheral area on the element substrate.

As a result, according to the driving circuit for an electro-optical panel of an aspect of the present invention, it is possible to perform the transmission precharge or sequential precharge with accomplishing miniaturization of the substrate or device or simplifying a device construction or a control condition on the substrate.

In an aspect of the driving circuit for an electro-optical panel according to the present invention, the data-line driving circuit, the sampling circuit and the precharge circuit may be arranged at one end of the data lines on the substrate. The image signal and the precharge signal may be written to the data lines from the one end of the data lines.

According to this aspect, both of the sampling circuit and the precharge circuit can be driven using one data-line driving circuit provided at one end of the data lines. Therefore, it is not necessary to secure a relatively large space on the defined element substrate, for example, as in a case where individual driving circuits having shift register circuits are provided at both ends of the data lines in the peripheral area on the element substrate, so that it is possible to promote miniaturization of the substrate or miniaturization of the whole electro-optical panel. Further, it is not necessary to draw out various complex or long signal lines on the substrate as in a case where the individual driving circuits are provided. Thus, it is possible to further reduce the total occupying area of the driving circuit on the substrate. Furthermore, capacitance of the lines is reduced due to reduction of the drawing-out amount of lines. Thus disadvantages, such as signal delays, etc. due to the capacitance of lines can be reduced or prevented. Therefore, even when employing a high-speed display mode with a high driving frequency, it is possible to secure the driving ability of the data-line driving circuit in accordance with the driving frequency. Thus, it is possible to reduce or prevent image defects such as ghost, etc.

In another aspect of the driving circuit for an electro-optical panel according to the present invention, a period when the precharge signal is written to the data lines in response to the (n−1)-th transmission signal and a period when the image signal is written to the data lines in response to the n-th transmission signal do not overlap with each other on the time axis.

According to this aspect, in a time period from a time point when the previous writing of the precharge signal to one data line is finished to a time point when the writing of the image signal to the one data line is started, a time gap exists.

That is, a time gap exists between a time point where the precharge-circuit driving signal becomes an "OFF level (for example, a low level)" in response to the (n−1)-th transmission signal and a time point when the sampling-circuit driving signal becomes an "ON (for example, a high level)" in response to the n-th transmission signal. The precharge-circuit driving signal or the sampling-circuit driving signal is generated after the output of the transmission signal is controlled or the signal processing is performed on the transmission signal such that both driving signals do not simultaneously become "ON". Therefore, in the sampling circuit and the precharge circuit, even if the transmission signal output from the same data-line driving circuit is shared as the driving signals, the image signal can be properly written without influence of the precharge signal. As a result, it is possible to reduce or prevent the deterioration of display quality, such as ghosts, etc. occurring when the precharge signal is simultaneously written to the data lines. Specifically, at the initial time of writing the image signal to the data lines.

In this aspect, a period when the image signal is written to one data line in response to the n-th transmission signal and a period when the precharge signal is written to another data line, to which the image signal is written after the one data line, in response to the n-th transmission signal may overlap at least partially with each other on the time axis.

According to this construction, the writing operation of the image signal and the writing operation of the precharge signal are sequentially advanced while overlapping with each other. Accordingly, for example, compared with a case where the precharge signal is previously written to all the data lines at one time, it is possible to efficiently perform the precharge for a shorter time. Since the precharge signal is always previously written to another data line, to which the image signal is written after the one data line, prior to writing the image signal thereto, the precharge signal is not deteriorated for a time period until the writing of the image signal is started. So it is possible to stabilize the voltage level of the data lines. Therefore, even when employing the high-speed display mode as described above, the sufficient and appropriate precharge can be performed. So it is possible to display images having excellent display quality.

The period when the image signal is written to one data line in response to the n-th transmission signal and the period when the precharge signal is written to another data line to which the image signal is written after the one data line in response to the n-th transmission signal may completely overlap with each other on the time axis, and may partially overlap with each other.

In another aspect of the driving circuit for an electro-optical panel according to an aspect of the present invention, the image signal is serial-to-parallel converted into m phase signals (m is a natural number greater than or equal to 2), the data lines are classified into simultaneously-driven data line group which include m data lines and which the same transmission signal is simultaneously written to, and a period when the precharge signal is written to the simultaneously-driven data line group, which the image signal is written to in response to the n-th transmission signal, in response to the (n−1)-th transmission signal and a period when the image signal is written to the simultaneously-driven data line group in response to the n-th transmission signal do not overlap with each other on the time axis.

According to this aspect, m sampling switches and m data lines corresponding thereto are connected to one sampling-circuit driving signal line. By supplying the transmission signals through one sampling-circuit driving signal line, the group of m sampling switches are simultaneously driven to perform the writing of the image signal. Therefore, the number of sampling-circuit driving signal lines can be reduced to 1/m of the number of data lines. The frequency of the shift register circuit constituting the data-line driving circuit can be reduced to 1/m. This is very advantageous in that the load of an external control circuit can be reduced, for example, when employing a high-speed display mode with a high driving frequency. In the precharge circuit, similarly, m precharge switches and m data lines corresponding thereto are connected to one precharge-circuit driving signal line. By supplying the transmission signals through one precharge-circuit driving signal line, the m precharge switches are simultaneously driven to perform the writing of the precharge signal. As a result, the number of precharge-circuit driving signal lines can be similarly reduced to 1/m. One precharge-circuit driving signal line is connected to the corresponding one sampling-circuit driving signal line, and the same transmission signal is shared as the sampling-circuit driving signal and the precharge-circuit driving signal. Therefore, the driving frequency of the shift register circuit is not further increased due to driving the precharge circuit. A relatively low driving frequency can be maintained, so that it is advantageous in employing the high-speed display mode.

In this aspect, the period when the precharge signal is written to a group of m data lines in response to the (n−1)-th transmission signal and the period when the image signal is written to the group of m data lines in response to the n-th transmission signal may not overlap with each other on the time axis. According to this construction, since a time gap exists between a time point when the previous writing of the precharge signal to the group of m data lines is finished and a time point when the writing of the image signal to the group of m data lines is started, even if the transmission signal output from the same data-line driving circuit is shared as the driving signal by the sampling circuit and the precharge circuit, it is possible to properly write the image signal without influence of the precharge signal.

In this aspect, a period when the precharge signal is written to the simultaneously-driven data line group, which the image signal is written to in response to the n-th transmission signal, in response to the (n−1)-th transmission signal and a period when the image signal is written to the simultaneously-driven data line group, which the image signal is written to in response to the (n−1)-th transmission signal, in response to the (n−1)-th transmission signal may overlap at least partially with each other on the time axis.

According to this construction, the writing operation of the image signal and the writing operation of the precharge signal are sequentially advanced while overlapping with each other. Further, the number of sampling-circuit driving signal lines is reduced to 1/m of the number of the data lines, and the frequency of the shift register circuit constituting the data-line driving circuit is reduced to 1/m. Accordingly, it is possible to efficiently perform the precharge for a much shorter time. This is very advantageous to the high-speed display mode in that a degree of freedom can be provided to the timing and time of supplying the precharge signal within one horizontal scanning period.

In this aspect, the precharge signal is always previously written to another data line group, to which the image signal is written after the one data line group, prior to writing the image signal thereto. As a result, the precharge signal is not deteriorated for a time period until the writing of the image signal is started, so that it is possible to stabilize the voltage level of the data lines. Therefore, even when employing the high-speed display mode as described above, the sufficient and appropriate precharge operation can be performed. So it is possible to display images having excellent display quality.

The period when the precharge signal is written to the simultaneously-driven data line group, which the image signal is written to in response to the n-th transmission signal, in response to the (n−1)-th transmission signal and the period when the image signal is written to the simultaneously-driven data line group, which the image signal is written to in response to the (n−1)-th transmission signal, in response to the (n−1)-th transmission signal may completely overlap with each other on the time axis, and may partially overlap with each other.

In another aspect of the driving circuit for an electro-optical panel according to the present invention, the data-line driving circuit includes an enable device to restrict a period when the transmission signals become a trigger level, such that a period when the precharge signal is written to the same data line and a period when the image signal is written to the same data line do not overlap with each other.

According to this aspect, selection of waveforms or shaping of the transmission signals are performed by the enable device, such that, for example, the adjacent n-th and (n−1)-th transmission signals do not overlap with each other on the time axis. As a result, the period when the n-th transmission signal becomes a trigger level of the sampling circuit and the image signal is written to the one data line or one data line group, and the period when the (n−1)-th transmission signal becomes a trigger level of the precharge circuit and the precharge signal is written to the one data line or the one data line group are restricted, so that both periods do not overlap with each other. Therefore, specifically, at the initial time of writing the image signal to the data lines, it is possible to reduce or prevent the defects, such as ghosts, etc. due to the simultaneous writing of the precharge signal to the data lines.

In the aspect employing the enable device, the enable device may restrict the period when the transmission signals become a trigger level, on the basis of enable pulses which are supplied externally, where the enable pulses adjacent to each other do not overlap with each other.

According to this construction, for example, logical products of the transmission signals output from the shift register circuit with the enable pulses input externally are performed. The logical products become a trigger level of the sampling circuit or the precharge circuit, only when the enable pulses become "ON (for example, a high level)". At that time, since the logical products are performed using the adjacent enable pulses which do not overlap with each other, the selection of waveforms and the shaping on the time axis is performed. As a result, it is possible to output the n-th transmission signal and the (n−1)-th transmission signal adjacent each other so as not to overlap with each other on the time axis. Therefore, the period when the image signal is written to one data line or one data line group in response to the n-th transmission signal and the period when the precharge signal is written to the one data line or the one data line group in response to the (n−1)-th transmission signal do not overlap. So it is possible to more reduce or prevent the defects, such as ghosts, etc.

In another aspect of the driving circuit for an electro-optical panel according to the present invention, a trimming device to restrict a period when the transmission signals become a trigger level is further provided between the precharge circuit and the sampling circuit, such that a period when the precharge signal is written to the same data line and a period when the image signal is written to the same data line do not overlap with each other.

According to this aspect, by the trimming device provided between the precharge circuit and the sampling circuit, the period when the transmission signals become a trigger level is restricted. As a result, the period when the precharge signal is written to the same data line and the period when the image signal is written to the same data line do not overlap. Therefore, it is possible to reduce or prevent the precharge signal and the image signal from being simultaneously written to one data line or one data line group. Therefore, for example, even when a deviation in the pulse width of the transmission signals becomes remarkable due to employing the high-speed display mode with a high driving frequency, it is possible to extremely effectively reduce or prevent the deterioration of display quality, such as ghosts, etc.

In this aspect, the trimming device may restrict the period when the precharge signal becomes a trigger level by trimming the precharge signal, which is output from the precharge circuit in response to the (n−1)-th transmission signal, in response to the n-th transmission signal in the precharge circuit and the sampling circuit connected to the same data lines.

According to this construction, for example, the trimming device trims the precharge signal output from the precharge circuit to one data line or one data line group in response to the (n−1)-th transmission signal, in response to the n-th transmission signal.

As a result, the period when the precharge signal becomes a trigger level is restricted. Therefore, the period when the image signal is written to one data line or one data line group in response to the n-th transmission signal and the period when the precharge signal is written to the one data line or the one data line group in response to the (n−1)-th transmission signal do not overlap, so that it is possible to reduce or prevent defects, such as ghosts, etc.

In another aspect of the driving circuit for an electro-optical panel according to the present invention, the shift register circuit is a bi-directional shift register circuit, a transmission direction in which the transmission signals are transmitted from a plurality of output terminals of the shift register circuit is controlled on the basis of a transmission-direction control signal from a common direction control signal section, and the driving circuit may include a selection circuit to select a supply source of the precharge-circuit driving signal in accordance with the transmission direction.

According to this aspect, the transmission signal preceding the transmission signal used to write the image signal is selected by the selection circuit. The selected transmission signal is used as the precharge-circuit driving signal. Accordingly, when the bi-directional shift register is used as the shift register circuit, it is possible to write the precharge signal prior to writing the image signal.

In this aspect, the selection circuit may select one transmission signal preceding the n-th transmission signal from the (n+1)-th transmission signal and the (n−1)-th transmission signal as the precharge-circuit driving signal on the basis of the transmission-direction control signal.

According to this construction, by the selection circuit, one transmission signal preceding the n-th transmission signal used for writing the image signal is selected from the (n+1)-th transmission signal and the (n−1)-th transmission signal preceding the n-th transmission signal on the basis of the transmission-direction control signal input to the selection circuit, and is used as the precharge-circuit driving signal. Therefore, even when the transmission signals are sequentially output in any direction from the bi-directional shift register circuit, it is possible to write the precharge signal from the precharge circuit prior to writing the image signal.

In order to accomplish the above an aspect of, the present invention provides an electro-optical device including the aforementioned driving circuit for an electro-optical panel (includes various aspects thereof) according to an aspect of the present invention, and the electro-optical panel.

In the electro-optical device according to an aspect of the present invention, since the driving circuit for an electro-optical panel according to an aspect of the present invention described above is provided, it is possible to display images having excellent display quality by performing the transmission precharge or sequential precharge with accomplishing miniaturization of the substrate or device or simplifying a device construction or a control condition on the substrate.

In order to accomplish the above an aspect of, the present invention provides an electronic apparatus including the aforementioned electro-optical device (includes various aspects thereof) according to an aspect of the present invention.

Since the electronic apparatus according to an aspect of the present invention includes the aforementioned electro-optical device according to an aspect of the present invention, it is possible to implement various electronic apparatus, such as a projection type display apparatus, a liquid crystal TV, a mobile phone, an electronic pocket book, a word processor, a view finder type or monitor direct view-type video tape recorder, a work station, a television phone, a POS terminal, a touch panel and the like, which are capable of displaying images having excellent display quality. As the electronic apparatus according to an aspect of the present invention, for example, an electrophoresis device or an EL (Electroluminescence) device can be implemented.

Such operations and other advantages of the present invention will be apparent from exemplary embodiments to be described later.

DETAILED DESCRIPTION OF EXEMPLARY EMBODIMENTS

Now, exemplary embodiments of the present invention will be described with reference to the figures. In the following exemplary embodiments, an electro-optical device according to the present invention is applied to a liquid crystal display device employing a TFT active matrix driving method.

First Exemplary Embodiment

A first exemplary embodiment of the electro-optical device according to the present invention will be described with reference to FIGS. 1 to 5.

Figure 1:
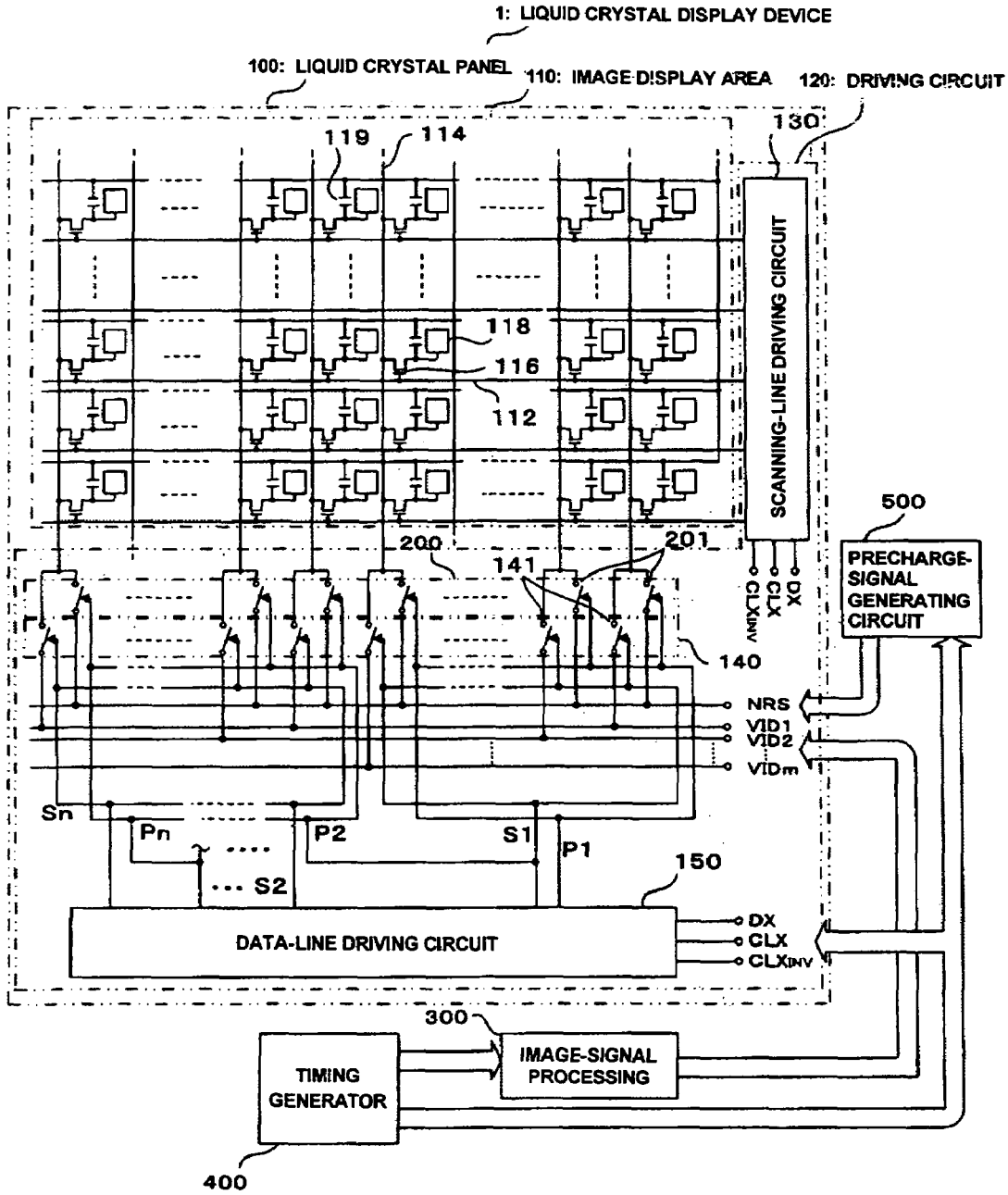
FIG. 1 is a schematic illustrating the whole construction of a liquid crystal display device according to a first exemplary embodiment of the present invention.

First, the whole construction of the electro-optical device according to the present invention will be described with reference to FIG. 1. FIG. 1 is a schematic illustrating the whole construction of a liquid crystal display device according to this exemplary embodiment.

As shown in FIG. 1, the liquid crystal display device 1 includes a liquid crystal panel 100 which is an example of an "electro-optical panel" according to an aspect of the present invention, an image-signal processing circuit 300, a timing generator 400, and a precharge-signal generating circuit 500, as important elements.

The liquid crystal panel 100 is constructed by arranging an element substrate on which TFTs 116, pixel electrodes, etc. as switching elements to switch pixels are formed in an image display area and a counter substrate on which a counter electrode, etc. are formed to face each other, bonding both substrates to each other with a predetermined gap therebetween, and inserting a liquid crystal into the gap.

The timing generator 400 outputs various timing signals to be used in each element. By a timing signal output device which is a part of the timing generator 400, a dot clock, which is a minimum unit clock and is used to scan the pixels, is generated. A transmission start pulse DX and a transmission clock CLX are generated on the basis of the dot clock.

The image-signal processing circuit 300 having received one type of image signals VID serial-to-parallel converts the image signals into m-phase image signals VID1 to VIDm, and outputs the m-phase image signals.

The precharge-signal generating circuit 500 generates a precharge signal and supplies the generated precharge signal to a precharge circuit. The precharge circuit and the precharge signal will be described in detail later.

The sampling circuit 140 and the precharge circuit 200 are shown as plural switch groups to sample the image signals VID and the precharge signal NRS, respectively, and practical constructions, operation and operational advantages thereof will be described in detail later.

In this exemplary embodiment, specifically, the liquid crystal panel 100 has the driving circuits built-in. A driving circuit 120 including the scanning-line driving circuit 130, the sampling circuit 140, the data-line driving circuit 150, and the precharge circuit 200 is constructed as an example of the "driving circuit" according to an aspect of the present invention on the element substrate. The driving circuit 120 may be formed in peripheral areas of the element substrate at the same time as forming TFTs 116, etc. corresponding to the pixels in the image display area 110. Alternatively, a part or all of the driving circuit 120 may be constructed as an external IC, and then may be provided externally or later on the element substrate.

The liquid crystal panel 100 includes the data lines 114 and the scanning lines 112 arranged vertically and horizontally in the image display area 110 occupying a central portion of the element substrate, and includes the pixel electrodes 118 and the TFTs 116 to switch and control the pixel electrodes 118, which are arranged in a matrix shape, in the respective pixels corresponding to intersections of the data lines and the scanning lines. The sampling circuit 140 samples the image signals VID1 to VIDm supplied to the image signal lines 301 in response to the sampling signals S1, S2 supplied from the data-line driving circuit 150, and then supplies the sampled image signals to the data lines 114.

The data lines 114 to be supplied with the image signals are electrically connected to the source electrodes of the TFTs 116. The scanning lines 112 to be supplied with the scanning signals are electrically connected to the gate electrodes of the TFTs 116. The pixels electrodes 118 are connected to the drain electrodes of the TFTs 116. Since each pixel includes the pixel electrode 118, the common electrode formed on the counter substrate, and the liquid crystal interposed between both electrodes, the pixels are arranged in a matrix shape correspondingly to the intersections of the scanning lines 112 and the data lines 114, respectively.

In order to reduce or prevent the held image signals from being leaked, storage capacitors 119 are provided in parallel to the liquid crystal capacitors formed between the pixel electrodes 118 and the counter electrode.

For example, since the voltages of the pixel electrodes 118 are held by the storage capacitors 119 for a time larger by a number of three ciphers than the time when the source voltage is applied, the retention property is enhanced. So it is possible to accomplish a high contrast ratio.

The driving circuit 120 includes the scanning-line driving circuit 130, the sampling circuit 140, the data-line driving circuit 150, and the precharge circuit 200 in the peripheral areas around the image display area 110. Since the active elements of these circuits can be all formed by combining p-channel TFTs and n-channel TFTs, by forming the active elements using the manufacturing process common to the TFTs 116 to switch the pixels, it is advantageous to integration, manufacturing cost, uniformity of elements, etc.

Here, the scanning-line driving circuit 130 of the driving circuit 120 has a shift register, and sequentially outputs the scanning signals to the scanning lines 112 on the basis of the clock signals CLY, the inverted clock signals $CLY_{INV}$ thereof, and the transmission start pulses DY from the timing generator 400.

Figure 2:
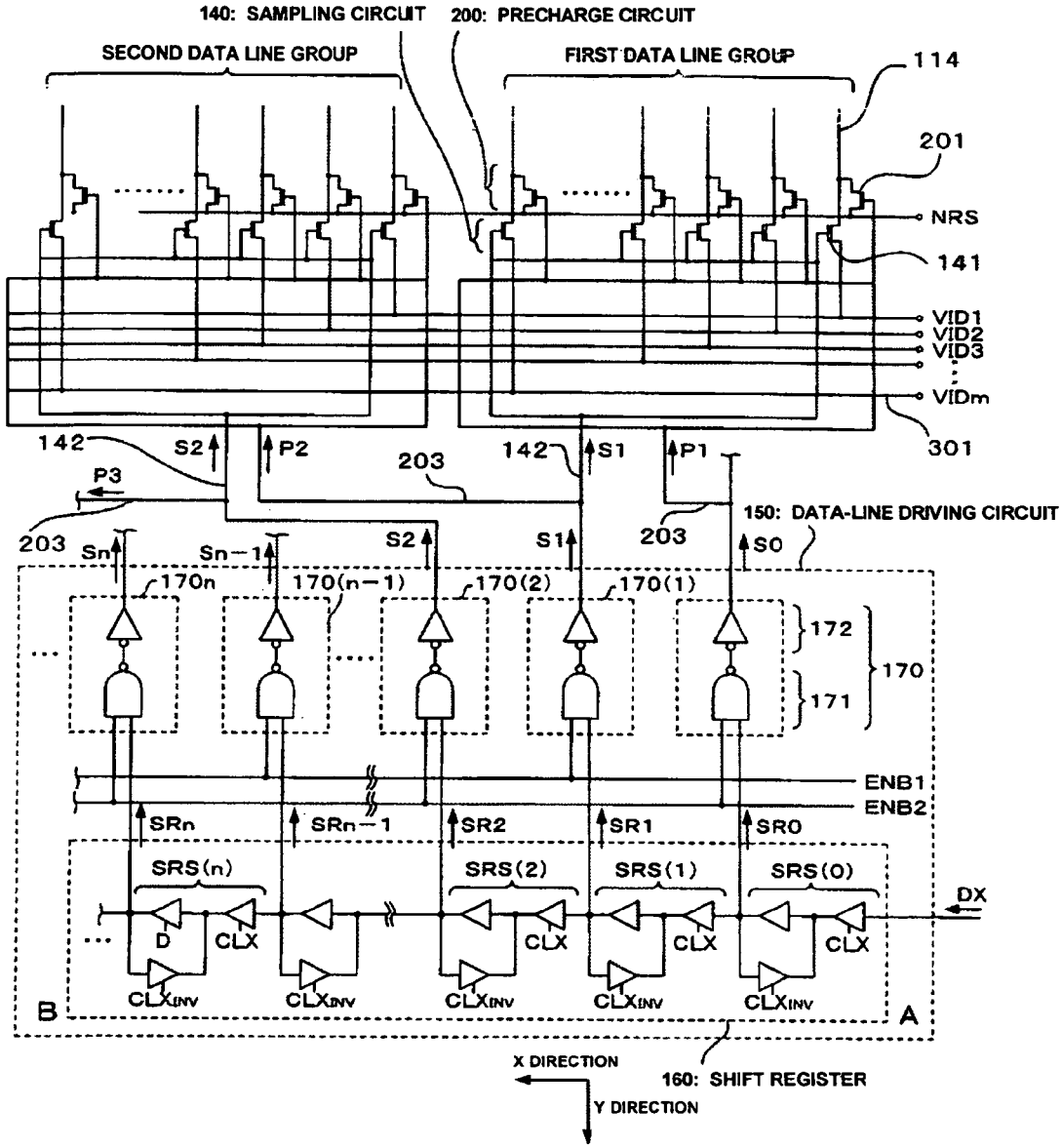
FIG. 2 is a circuit schematic illustrating details of a sampling circuit, a data-line driving circuit, and a precharge circuit according to the first exemplary embodiment.
Figure 3:
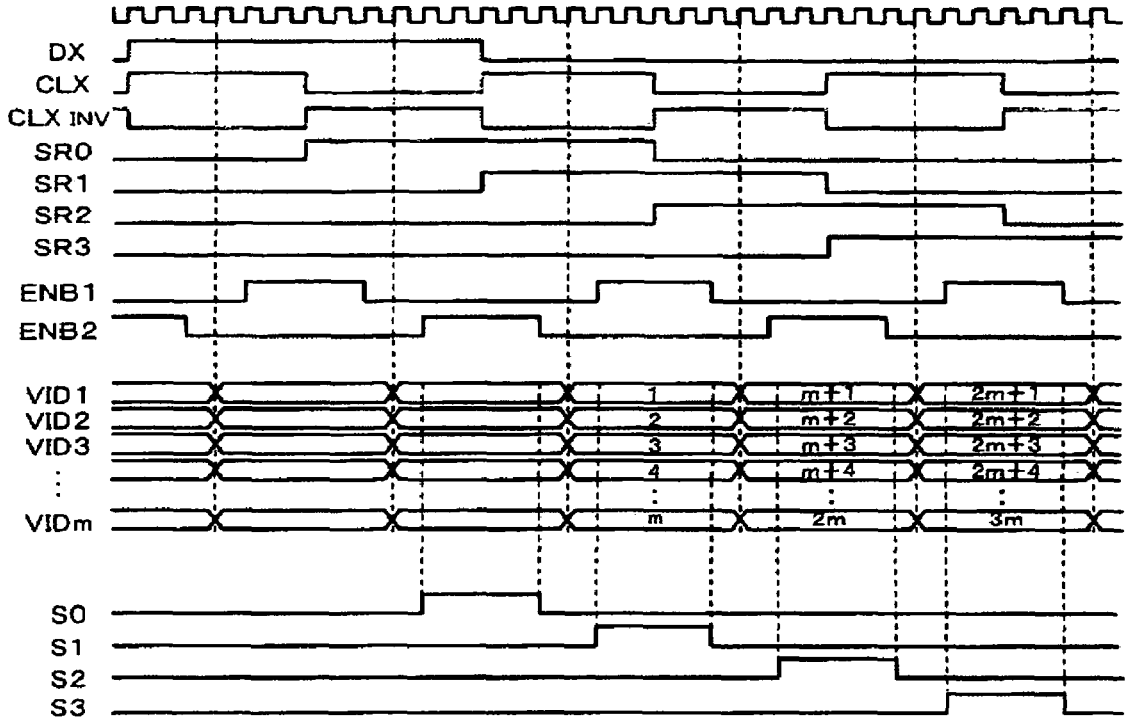
FIG. 3 is a timing chart illustrating conditions of some important signals of the logic circuit schematic shown in FIG. 2.

Next, the constructions and operation of the sampling circuit 140 and the data-line driving circuit 150 according to this exemplary embodiment will be described with reference to FIGS. 2 and 3. Here, FIG. 2 is a circuit schematic illustrating details of the sampling circuit, the data-line driving circuit and the precharge circuit according to this exemplary embodiment. FIG. 3 is a timing chart illustrating variation with time of the various signals correspondingly thereto. The construction and operation of the precharge circuit will be described in detail later.

As shown in FIG. 2, the data-line driving circuit 150 includes a shift register 160 to sequentially drive the data lines 114. The transmission start pulse DX to start the transmission of the sampling-circuit driving signals is input to the shift register 160. The transmission signals SR1, SR2, . . . are sequentially output in a transmission direction corresponding to the X direction shown in FIG. 2 from the respective stages SRS(*i*) (i=0, 1, 2, 3, . . . , n, . . . ) of the shift register 160.

Next, the data-line driving circuit 150 includes enable circuits 170 (hereinafter, "enable circuit 170(*i*) (i=0, 1, 2, . . . , n, . . . )" correspondingly to the respective stages SRS(*i*) of the shift register 160) constituting an example of the "enable device" according to an aspect of the present invention. The enable circuits 170 are provided between the shift register 160, and the sampling circuit 140 and the precharge circuit 200, and include an NAND circuit 171 and an inverter 172, respectively.

The transmission signals SR1, SR2, . . . output from the shift register 160 are supplied to the enable circuits 170(1), 170(2), . . . . Enable signals ENB1 and ENB2 are input to the other input terminals of the enable circuits 170(1) and 170(2), respectively. As a result, the transmission signals SR1, SR2, . . . are output (that is, the transmission signals SR1, SR2, . . . are at a high level), and the data lines 114 are driven only when the enable signal ENB1 or ENB2 is output (that is, the enable signals ENB1 or ENB2 is at a high level. That is, the data lines 114 are controlled to be activated when the image signals VID are stably output by using the enable signal ENB1 or ENB2.

The logical products of the transmission signals SR1, SR2, . . . and the enable signal are performed by the enable circuits, 170(1), 170(2), . . . , and then the resultant signals are supplied to the sampling circuit 140, as the data-line driving signals or the sampling-circuit driving signals (hereinafter, "sampling signals") S1, S2, . . . which are an example of the "sampling pulses" according to an aspect of the present invention.

As shown in FIG. 2, the transmission signal SR0 is output from SRS(0) corresponding to the first stage of the shift register 160. The sampling signal S0 is output through the enable circuit 170(0). However, the sampling signal S0 is not supplied to any sampling circuit, and is used only as the precharge-circuit driving signal to be described later. Therefore, in the above description, since the sampling signal supplied to the first data line group is allowed to correspond to "S1", the elements and signals corresponding to the first stage SRS(0) of the shift register 160 are denoted by a reference numeral "0". The second stage SRS(1) of the shift register 160 is handled as a "first stage". This is true of the following description.

In this exemplary embodiment, specifically, the enable circuits 170 function to restrict a period when the transmission signals become a trigger level (hereinafter, "enable device"), such that a period when the precharge signal is written to one data line and a period when the image signals are written to the one data line do not overlap with each other, and in addition such that a period when the image signals are written to the data lines 114 belonging to one data line group which is simultaneously driven and a period when the image signals are written to the data lines 114 belonging to another data line group adjacent to the one data line group do not overlap with each other. The operation and advantages of the enable device will be described in detail later.

The sampling circuit 140 includes a plurality of sampling switches 141, each of which includes a first conductive TFT. The sampling switch 141 may include one of a p-channel TFT and an n-channel TFT, and may include a CMOS TFT.

In the sampling circuit 140, m data lines 114 are classified to constitute one group. The sampling circuit 140 samples the image signals VID1 to VIDm serial-to-parallel converted into m phase signals corresponding to the sampling signals S1, S2, . . . with respect to the data lines 114 belonging to the one group, and sequentially supplies the sampled image signals to the data lines 114. Specifically, in the sampling circuit 140, the sampling switches 141 are provided at one ends of the data lines 114. The source electrode of each sampling switch 141 is connected to the signal line to be supplied with one of the image signals VID1 to VIDm. The drain electrode thereof is connected to one data line 114. The gate electrode of each sampling switch 141 is connected to one of the signal lines to be supplied to the sampling signals S1, S2, . . . correspondingly to the one group. In this exemplary embodiment, since the image signals VID1 to VIDm are supplied in parallel, each data line group is simultaneously sampled in response to the sampling signals S1, S2, . . .

As shown in the timing chart of FIG. 3, the transmission start pulse DX input to the shift register 160 is shifted in a unit of a half cycle of the transmission clock CLX in the shift register 160 in response to the data-line transmission clock CLX (hereinafter, "transmission clock CLX") and the inverted clock signal $CLX_{INV}$. As a result, the transmission signals SR1, SR2, . . . which are delayed by a half cycle of the transmission clock are sequentially output from the output terminals of the shift register 160.

In order to synchronize a driving period of the data lines 114 with a stable output period of the image signals VID1 to VIDm, the logical products of the transmission signals SR1, SR2, . . . and the enable signal ENB1 or ENB2 are performed by the enable circuits 170(1), 170(2), . . . , and then the logical products are output as the sampling signals S1, S2, . . . . As a result, the image signals and the sampling signals (for example, the image signals VID1 to VIDm and the sampling signal S1) are synchronized with each other, so that a correct display can be performed. At that time, specifically, as shown in FIG. 3, by restricting the period when the sampling signals S1, S2, . . . become a high level on the basis of the enable signal ENB1 or ENB2 the periods of turning to a high level of which do not overlap each other, the periods when the respective sampling signals S1, S2, . . . become a high level or a trigger level do not overlap.

In this exemplary embodiment, specifically, the data lines 114 are classified into data line groups, each of which includes m data lines, and by supplying the sampling signal (one of S1, S2, . . . ) to the respective data line groups through one sampling-circuit driving signal line 142 corresponding to the same transmission signal supplied from the shift register 160, the image signals are sampled. That is, the number of sampling-circuit driving signal lines 142 is 1/m of the number of data lines. As a result, the frequency of the shift register 160 is reduced into 1/m, compared with a case where one data line is driven by one stage thereof. Therefore, when employing a high-speed display mode with a high driving frequency, this construction is advantageous in that load of an external control circuit can be reduced.

Figure 4:
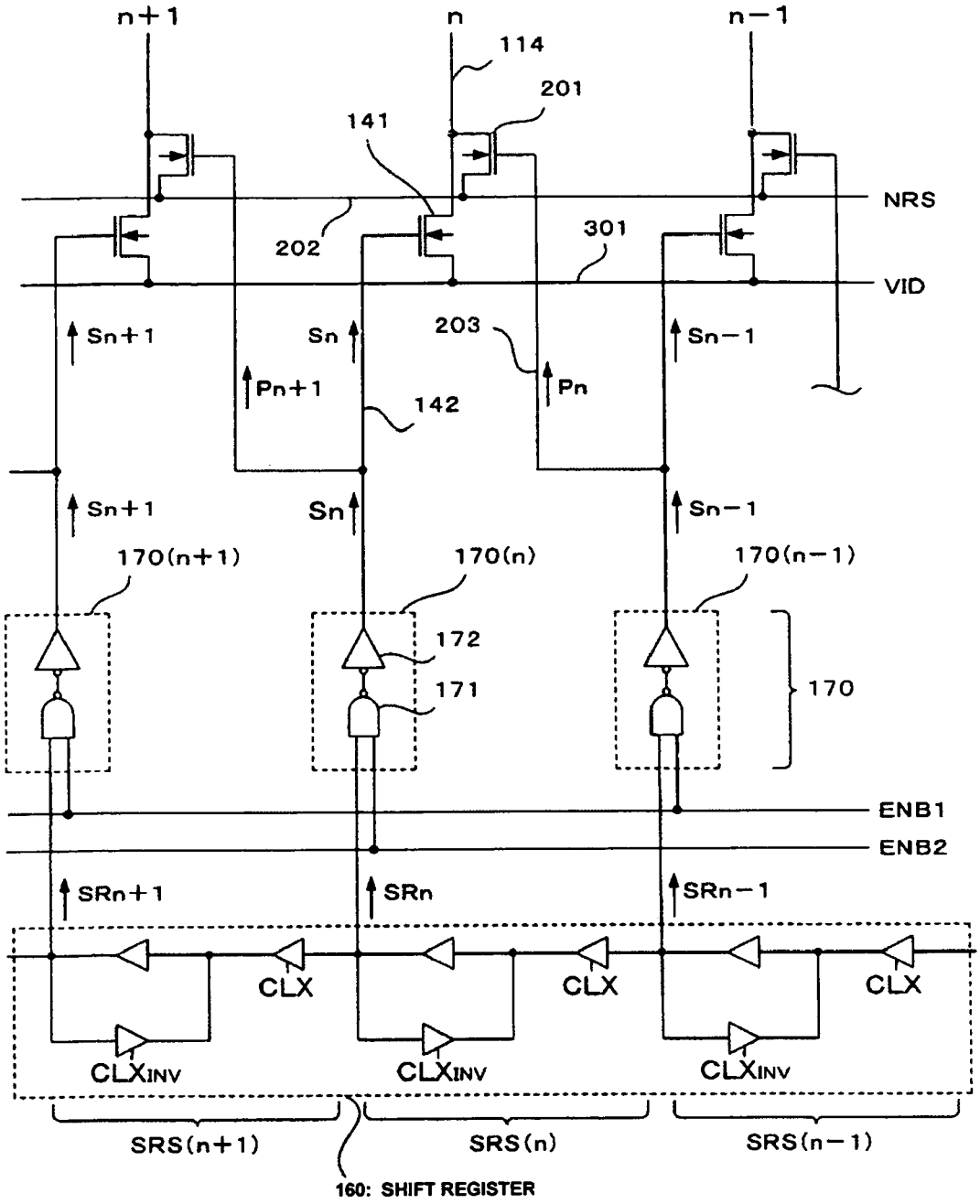
FIG. 4 is a circuit schematic illustrating a construction of the precharge circuit according to the first exemplary embodiment, where a part of the precharge circuit corresponding to (n−1)-th, n-th, and (n+1)-th data line groups is extracted and illustrated.
Figure 5:
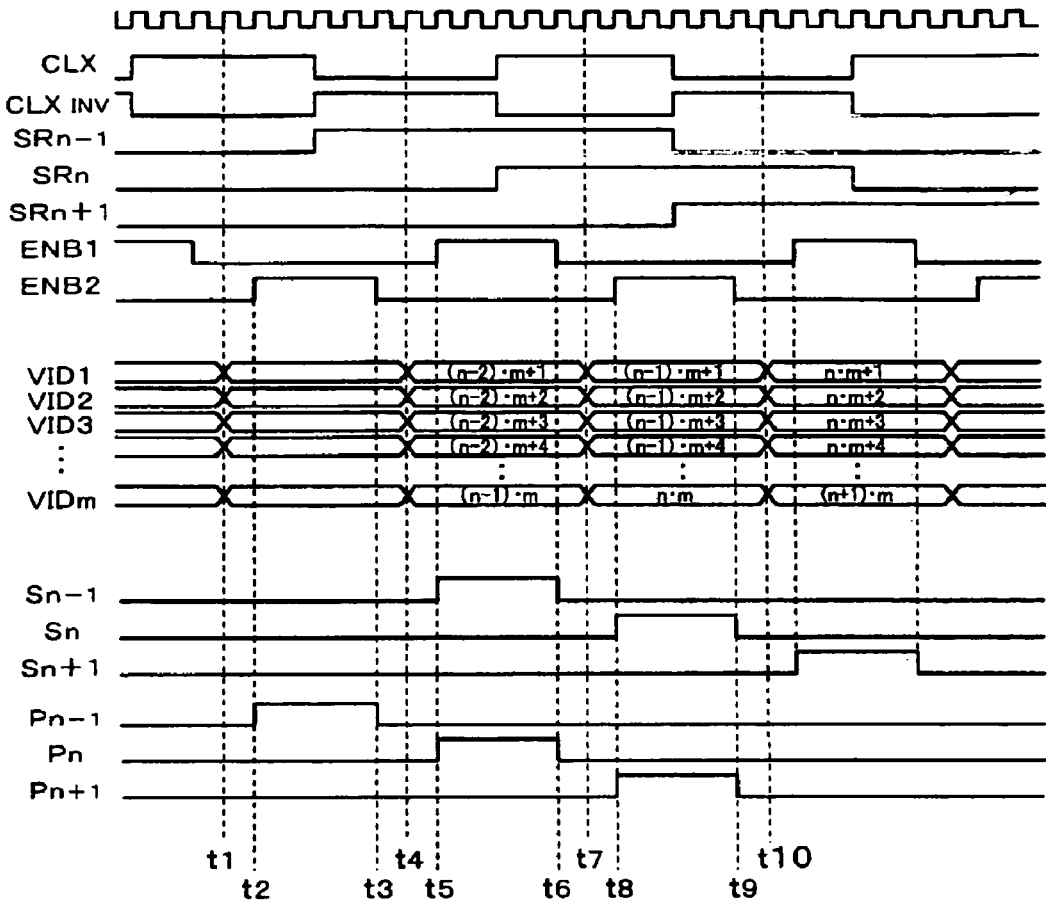
FIG. 5 is a timing chart illustrating change of some important signals with time corresponding to the (n−1)-th, n-th, and (n+1)-th data line groups in the first exemplary embodiment.

Next, the construction and operation of the precharge circuit 200 according to this exemplary embodiment will be described in detail with reference to FIGS. 4 and 5, in addition to FIG. 2. In FIG. 2, the detailed construction of the precharge circuit 200 according to this exemplary embodiment, and connections between the precharge circuit 200 and the data-line driving circuit 150 are illustrated in addition to the sampling circuit 140 and the data-line driving circuit 150 described above. Here, FIG. 4 is a circuit schematic illustrating the construction of the precharge circuit 200 according to this exemplary embodiment shown in FIG. 2, where a part of the precharge circuit corresponding to (n−1)-th, n-th, and (n+1)-th data line groups is extracted and illustrated. FIG. 5 is a timing chart illustrating variations of some important signals with time corresponding to the (n−1)-th, n-th, and (n+1)-th data line groups. In FIG. 4, for the purpose of simplification, among the m switching elements of the sampling circuit 140 and the precharge circuit 200 corresponding to the m data lines in the respective data line groups, only one switching element is shown for the respective data line groups. Specifically, only a portion corresponding to one data line is shown, and one image signal line is shown for the respective image signal line groups converted into m phase signals.

As shown in FIG. 2, the precharge circuit 200 includes a plurality of precharge switches 201 having a first conductive type TFT to sample the precharge signal NRS as a switch to sample the precharge signal NRS. Each precharge switch 201 may include one of a p-channel TFT and an n-channel TFT, and may include a CMOS TFT.

The source electrode of each precharge switch 201 is connected to a precharge signal line 202, and the drain electrode thereof is connected to one data line 114. The gate electrode of each precharge switch 201 is connected to the precharge-circuit driving signal line 203. The source electrodes of the precharge switches 201 are supplied with the precharge signal NRS of a predetermined voltage through the precharge signal line 202 from the external precharge-signal generating circuit 500. The gate electrodes are supplied with the precharge-circuit driving signals P1, P2, . . . through the precharge-circuit driving signal lines 203 at a timing (details of which are described later) preceding the writing of the image signals VID. Thus the precharge switches 201 are turned-on, so that the precharge signal NRS is written to the respective data lines 114. Here, the precharge signal NRS supplied to the precharge circuit 200 is a signal set to, for example, a proper potential level corresponding to an intermediate gray-scale level or a gray color level. By writing the precharge signal NRS to the data lines 114 prior to supply of the image signals VID to the data lines 114, it is possible to reduce the amount of electric charges required to write the image signals VID to the data lines 114. As a result, even when the image signals VID are supplied to the data lines 114 with a high frequency, the potential level of the respective data lines 114 is stabilized. So it is possible to accomplish reduction of line unevenness on a display screen and enhancement of a contrast ratio. The lack of writing ability of writing the image signals VID to the data lines 114 is addressed substantially or practically, so that it is possible to display images having excellent display quality with reduced ghosts in accordance with the image signals written with the relatively sufficient writing ability.

The precharge signal NRS supplied to the precharge circuit 200 has the same polarity as the image signal, and may be a signal (an auxiliary image signal) corresponding to pixel data of an intermediate gray-scale level. In this exemplary embodiment, in order to drive the liquid crystal display device 1 in the AC mode, the voltage polarity of the image signals is inverted every predetermined cycle, such as a horizontal scanning period (1 frame) or one field (for example, two frames). But when the precharge signal NRS is supplied thereto, the load in writing the image signals is reduced, and the potential level of the data lines 114 is stabilized regardless of the potential level applied previously. As a result, the present image signals can be supplied to the data lines 114 with a stable potential.

In this exemplary embodiment, in the precharge circuit 200, one precharge-circuit driving signal line is connected to m precharge switches 201, and is connected to m data lines corresponding to the m precharge switches, respectively, similarly to the sampling circuit 140. By supplying the precharge-circuit driving signal (one of P1, P2, . . . ) to one data line group having the m data lines from the one precharge-circuit driving signal line 203, the m precharge switches 201 are simultaneously driven, thereby writing the precharge signal NRS. As a result, the number of precharge-circuit driving signal lines is similarly reduced into 1/m of the number of data lines.

In this exemplary embodiment, specifically, one precharge-circuit driving signal line 203 is connected to one sampling-circuit driving signal line 142. The same transmission signal output from the data-line driving circuit 150 is shared as the sampling-circuit driving signal and the precharge-circuit driving signal corresponding thereto, thereby driving the precharge circuit 200.

Specifically, as shown in FIG. 4, one data line in the n-th data line group is connected to the drain electrode of one switching element 141 to sample the image signals and the drain electrode of one precharge switch 201 to sample the precharge signals. This is true of the (n−1)-th and (n+1)-th data line groups. The precharge-circuit driving signal line 203 connected to the gate electrode of the n-th precharge switch 201 is connected to the (n−1)-th sampling-circuit driving signal line 142. According to this construction, a logical product of the transmission signal SRn−1 output from the (n−1)-th stage SRS(n−1) of the shift register and the enable signal is performed by the enable circuit 170(n−1). The logical product is supplied as the sampling-circuit driving signal Sn−1 to the sampling circuit group corresponding to the (n−1)-th data line group and is supplied as the precharge-circuit driving signal Pn to the precharge circuit group corresponding to the n-th data line group. The transmission signal SRn−1 is shared to drive the sampling circuit group corresponding to the (n−1)-th data line group and drive the precharge circuit group corresponding to the n-th data line group. Similarly, the transmission signal SRn is shared to drive the sampling circuit group corresponding to the n-th data line group and drive the precharge circuit group corresponding to the (n+1)-th data line group.

Since the transmission signals Sri (i=0, 1, 2, . . . ) are sequentially shifted and output by the shift register 160, the transmission signal SRn is delayed and output successively to output of the transmission signal SRn−1. Here, when the transmission signal SRn is output, the precharge circuit group corresponding to the n-th data line group is driven in response to the aforementioned transmission signal SRn−1 and the precharge signal NRS is already written, so that when the image signals are written to the n-th data line group in response to the transmission signal SRn, the n-th data line group is precharged to a predetermined potential. This is true of the relation between the transmission signal SRn and the transmission signal SRn+1.

By sequentially performing such series of operation in the transmission direction (X direction) of the shift register for one horizontal scanning period, the sequential precharge or transmission precharge is performed. Here, specifically, the writing operation of the image signals and the writing operation of the precharge signals are performed while sequentially overlapping with each other. Furthermore, the number of sampling-circuit driving signal lines 142 is reduced to 1/m of the number of data lines 114. The frequency of the shift register circuit constituting the data-line driving circuit is also reduced into 1/m. Therefore, for example, compared with the method of writing the precharge signals to all data lines at a time, it is possible to more efficiently perform the precharge for a shorter time as a whole in one horizontal scanning period.

Since the precharge signals are previously written to the n-th data line group, to which the image signals are written after the (n−1)-th data line group, always right before the image signals are written thereto, the precharge signals are not deteriorated until the writing of the image signals is started. So it is possible to stabilize the voltage level of the data lines. Therefore, even when employing a high-speed display mode as described above, the sufficient and proper precharge can be performed. So it is possible to display images having excellent display quality.

In this exemplary embodiment, in order to drive the precharge circuit, it is not necessary to provide a driving circuit (for example, an exclusive precharge-circuit driving circuit) having another shift register circuit on the element substrate. One data-line driving circuit 150 can drive both of the sampling circuit 140 and the precharge circuit 200. Therefore, for example, as a case where driving circuits having individual shift register circuits are provided at both ends of the data lines, it is not necessary to secure a relatively large space on the defined element substrate, so that it is possible to promote miniaturization of the substrate or miniaturization of the whole electro-optical panel.

Here, specifically, according to the above construction, the precharge circuit 200 is arranged in an area between the image display area 110 and the data-line driving circuit 150 on the element substrate of the liquid crystal panel 100. Specifically, at one end of the data lines 114. The image signals VID and the precharge signals NRS are written from the one end of the data lines (see FIG. 1, etc.). Therefore, as a case where individual driving circuits are provided at both ends of the data lines, it is not necessary to draw out various signal lines complexly on the substrate. So it is possible to further reduce an area which the whole driving circuit occupies on the substrate. The load of capacitance due to the drawing-out of wires is reduced. So it is possible to reduce or prevent disadvantages such as a signal delay, etc. due to the load. This allows the driving ability of the data-line driving circuit to be secured in accordance with the driving frequencies. For example, even when employing a high-speed display mode with a high driving frequency. So it is possible to reduce or prevent image defects, such as ghosts, etc.

Next, the precharge operation in this exemplary embodiment will be further described with reference to the timing chart of FIG. 5.

As shown in FIG. 5, with regard to the (n−1)-th, n-th and (n+1)-th data line groups, similarly to the timing chart shown in FIG. 3, the transmission signals are shifted in a unit of a half cycle of the transmission clock CLX by the shift register 160, and the transmission signals SRn−1, SRn, SRn+1 . . . , which are delayed by a half cycle of the transmission clock, are sequentially output from the output terminals of the shift register 160. In order to synchronize the driving period of the data lines 114 with the stable output period of the image signals VID1 to VIDm, logical products of the transmission signals SRn−1, SRn and SRn+1, and the enable signal ENB1 or ENB2 are performed by the enable circuits 170(n−1), 170(*n*) and 170(n+1). The logical products are output as the sampling signals Sn−1, Sn and Sn+1. Here, as described above, since the (n−1)-th sampling-circuit driving signal line 142 is also connected to the n-th precharge-circuit driving signal line 203, the precharge-circuit driving signal Pn becomes a trigger level at the same time when the sampling signal Sn−1 becomes a trigger level (t5). Therefore, the sampling signal Sn becomes a trigger level (t8), and the precharge signal is written prior to writing the image signals to the n-th data line group.

In this exemplary embodiment, specifically, the enable circuit 170 in the data-line driving circuit 150 functions as the "enable device" to restrict the period when the transmission signals become a trigger level, such that a period when the precharge signal NRS is written to the same data line 114 and a period when the image signals VID are written to the same data line 114 do not overlap with each other.

Specifically, as shown in FIG. 5, in periods when the transmission signals SRn−1 and SRn output from the shift register 160 become "ON (that is, a high level)", a period (a period when all become "ON") when the periods overlap with each other on the time axis exists. Therefore, the logical product of the transmission signals and the enable pulse ENB1 and ENB2 is performed by each enable circuits 170(n−1), 170(*n*). Here, specifically, since the adjacent enable pulses ENB1 and ENB2 are output so as not to overlap with each other on the time axis, the sampling signals Sn−1 and Sn which become a trigger level is output only for the period when the enable pulses become "ON (a high level)". In the enable circuits, selection of waveforms on the time axis is performed on the transmission signal SRn−1 and SRn, such that the adjacent sampling signals Sn and Sn−1 are output so as not to overlap with each other. Since the sampling signal Sn−1 itself becomes the n-th (next stage) precharge-circuit driving signal Pn, the precharge-circuit driving signal Pn and the sampling signal Sn do not overlap with each other, similarly. Specifically, paying attention to the n-th data line group, a period when the precharge signal NRS is previously written in response to the precharge-circuit driving signal Pn and a period when the image signals VID are written in response to the sampling signal Sn do not overlap with each other. This is true of the relation between the sampling signal Sn and the precharge-circuit driving signal Pn+1.

By employing the "enable device" functioning in this way, it is possible to surely reduce prevent a defect, such as ghosts, etc. occurring when the image signals and the precharge signals are simultaneously written to one data line or one data line group.

In this exemplary embodiment, the adjacent enable pulses ENB1 and ENB2 are output with a width smaller than the half cycle of the clock signal CLK. For example, the width between the time points t5 and t6 or the time points t8 and t9 shown in FIG. 5 is smaller than the width between the time points t4 and t7 or the time points t7 and t10. By outputting the enable pulses in this way, the adjacent sampling signals Sn−1 and Sn output after the logical product of the enable pulses and the sampling signals is performed and the selection of waveforms is performed are separated on the time axis. Therefore, as described above, the sampling signal Sn−1 itself becomes the n-th (that is, the next stage) precharge-circuit driving signal Pn, the precharge-circuit driving signal Pn and the sampling signal Sn are similarly separated each other on the time axis. That is, paying attention to the n-th data line group, from a time point when the writing of the precharge signal NRS in response to the precharge-circuit driving signal Pn is finished to a time point when the writing of the image signals VID in response to the sampling signal Sn is started, a time margin (for example, a period between the time points t6 and t8) is secured. As a result, since the period when the precharge signal NRS is previously written and the period when the image signals are written are separated each other on the time axis, it is possible to reduce or prevent defects, such as ghosts, etc.

Second Exemplary Embodiment

Figure 6:
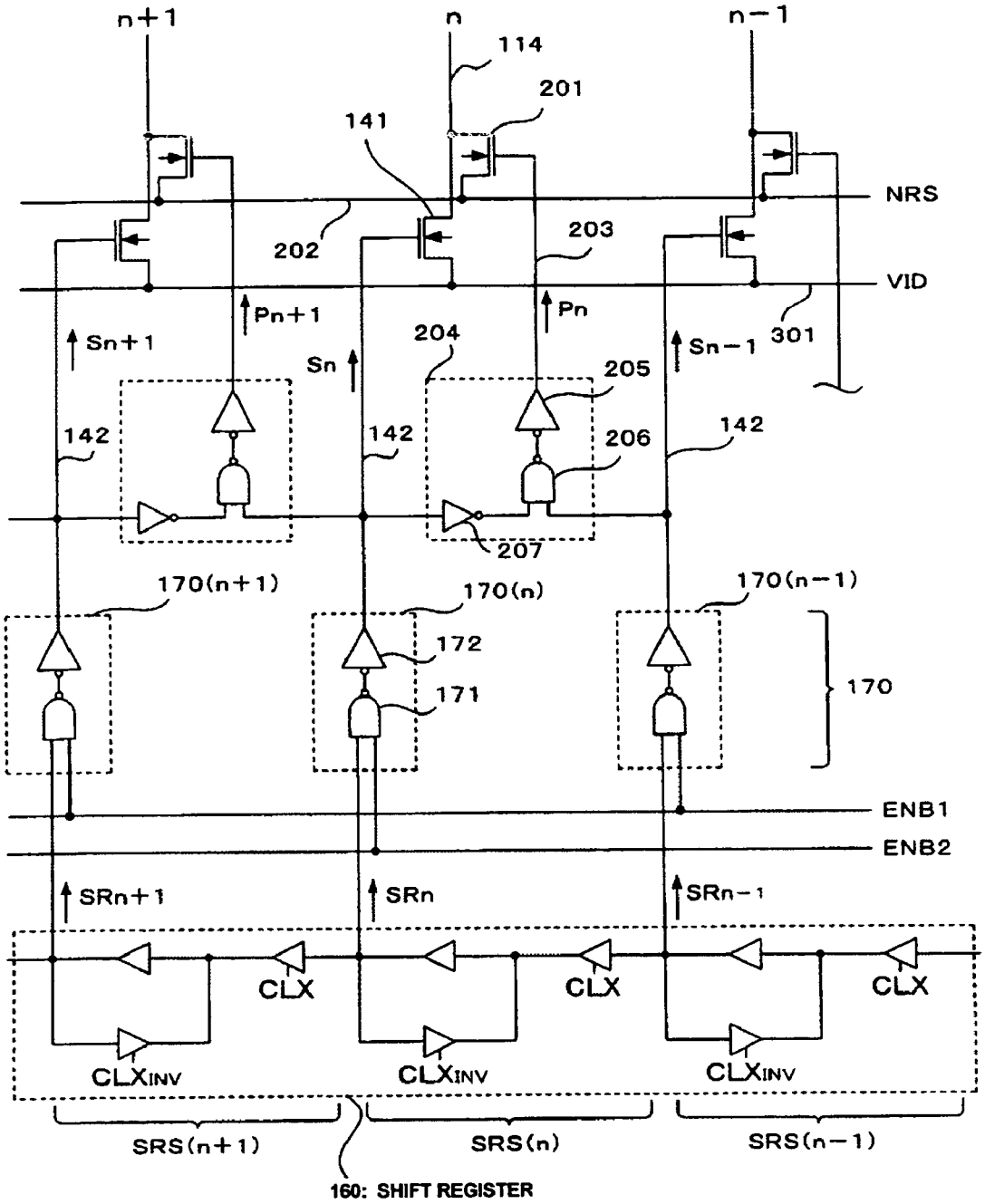
FIG. 6 is a circuit schematic illustrating a construction of a precharge circuit according to a second exemplary embodiment, where a part of the precharge circuit corresponding to (n−1)-th, n-th, and (n+1)-th data line groups is extracted and illustrated.
Figure 7:
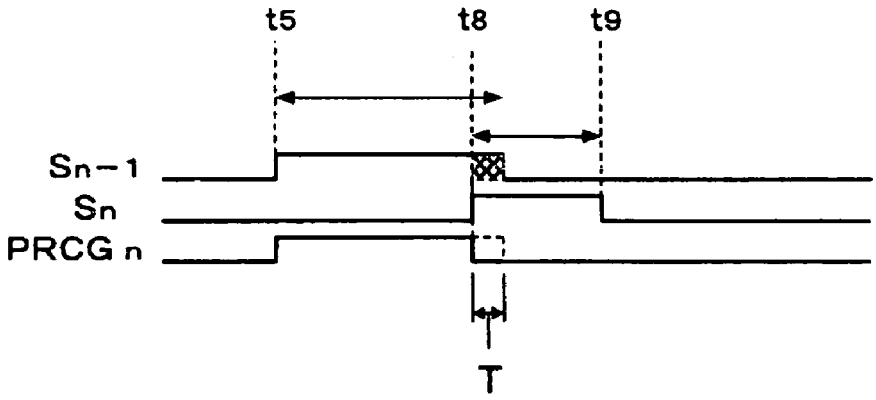
FIG. 7 is a timing chart illustrating change in a trimming condition with time of a trimming circuit according to the second exemplary embodiment.

Now, a second exemplary embodiment of the electro-optical device according to the present invention will be described with reference to FIGS. 6 and 7. FIG. 6 is a circuit schematic illustrating a construction of the precharge circuit 200 according to this exemplary embodiment, where a part of the precharge circuit corresponding to the (n−1)-th, n-th, and (n+1)-th data line groups is extracted and illustrated. FIG. 7 is a timing chart illustrating a trimming condition by a "trimming device" according to this exemplary embodiment.

The second exemplary embodiment is different from the aforementioned first exemplary embodiment in circuit constructions between the adjacent sampling-circuit driving signal lines and in the method of supplying the precharge-circuit driving signal. Therefore, circuit constructions and operation of the shift register circuit and the enable circuit, and the whole construction of the liquid crystal display device are similar to those of the first exemplary embodiment. As a result, the constructions different from the first exemplary embodiment will be described hereinafter. The elements common to the first exemplary embodiment are denoted by the same reference numerals, and descriptions thereof will be omitted.

In this exemplary embodiment, "trimming device" to restrict a period when the transmission signals become a trigger level is further provided between the precharge circuit 200 and the sampling circuit 140. So the period when the precharge signal NRS is written to the same data line group and the period when the image signals VID are written to the same data line group do not overlap with each other.

As shown in FIG. 6, in this exemplary embodiment, a trimming circuit 204 is provided between the (n−1)-th sampling-circuit driving signal line 142 and the n-th sampling-circuit driving signal line 142. The trimming circuit 204 includes an inverter 205, an NAND circuit 206 and an inverter 207. The inverter 205 and the NAND circuit 206 are provided on the precharge-circuit driving signal line 203. The inverter 205 is connected to the gate electrodes of the precharge switches 201. One input terminal of the NAND circuit 206 is connected to the sampling-circuit driving signal line 142 corresponding to the (n−1)-th data line group. The other input terminal of the NAND circuit 206 is connected to the inverter 207, and is also connected to the sampling-circuit driving signal line 142 corresponding to the n-th data line group.

The logical product of the output from the enable circuit 170(n−1) corresponding to the n-th data line group in which the sampling signal Sn−1 corresponding to the (n−1)-th data line group is used and the inverted signal of the sampling signal Sn corresponding to the n-th data line group is performed by the NAND circuit 206. The logical product is input to the gate electrode of the n-th precharge switch 201 through the inverter 205. As a result, for the period when the sampling signal Sn becomes "ON (a high level)", specifically, a trigger level, the precharge-circuit driving signal Pn input to the gate electrode of the precharge switch 201 necessarily becomes "OFF (a low level)". Only when the sampling signal Sn−1 becomes "OFF", the sampling signal Sn−1 of the previous stage becomes "ON", so that the precharge-circuit driving signal Pn becomes "ON", that is, a trigger level. The trimming circuit 204 restricts the period when the precharge-circuit driving signal Pn becomes a trigger level, depending upon "ON" or "OFF" of the sampling signal Sn with respect to the n-th data line group.

Here, for example, it is supposed that the pulse width of the sampling signal is varied remarkably with an increase of the driving frequency due to employing a high-speed display mode. A case where the adjacent sampling signals Sn−1 and Sn overlap on the time axis occurs as shown in FIG. 7. In this case, the overlapping period T is trimmed by the aforementioned "trimming device", and the precharge-circuit driving signal Pn is input as a trimming signal PRCGn to the precharge switch 201. Therefore, it is possible to surely reduce or prevent the sampling signal Sn and the precharge-circuit driving signal Pn from overlapping each other.

According to the "trimming device" described above, even when the transmission signals output from the shift register 160 are shared as the precharge-circuit driving signals and the sampling-circuit driving signals, the period when the image signal is written to one data line group and the period when the precharge signal is written to the one data line group substantially or never overlap with each other on the time axis. Therefore, it is possible to reduce or prevent defects, such as ghosts, etc. occurring when both signals are simultaneously written.

In this exemplary embodiment, the "enable device" including the enable circuit 170 may be not provided. Also in this case, it is possible to reduce or prevent the image signal and the precharge signal from being simultaneously written to one data line group by using the "trimming device" according to this exemplary embodiment.

Third Exemplary Embodiment

Figure 8:
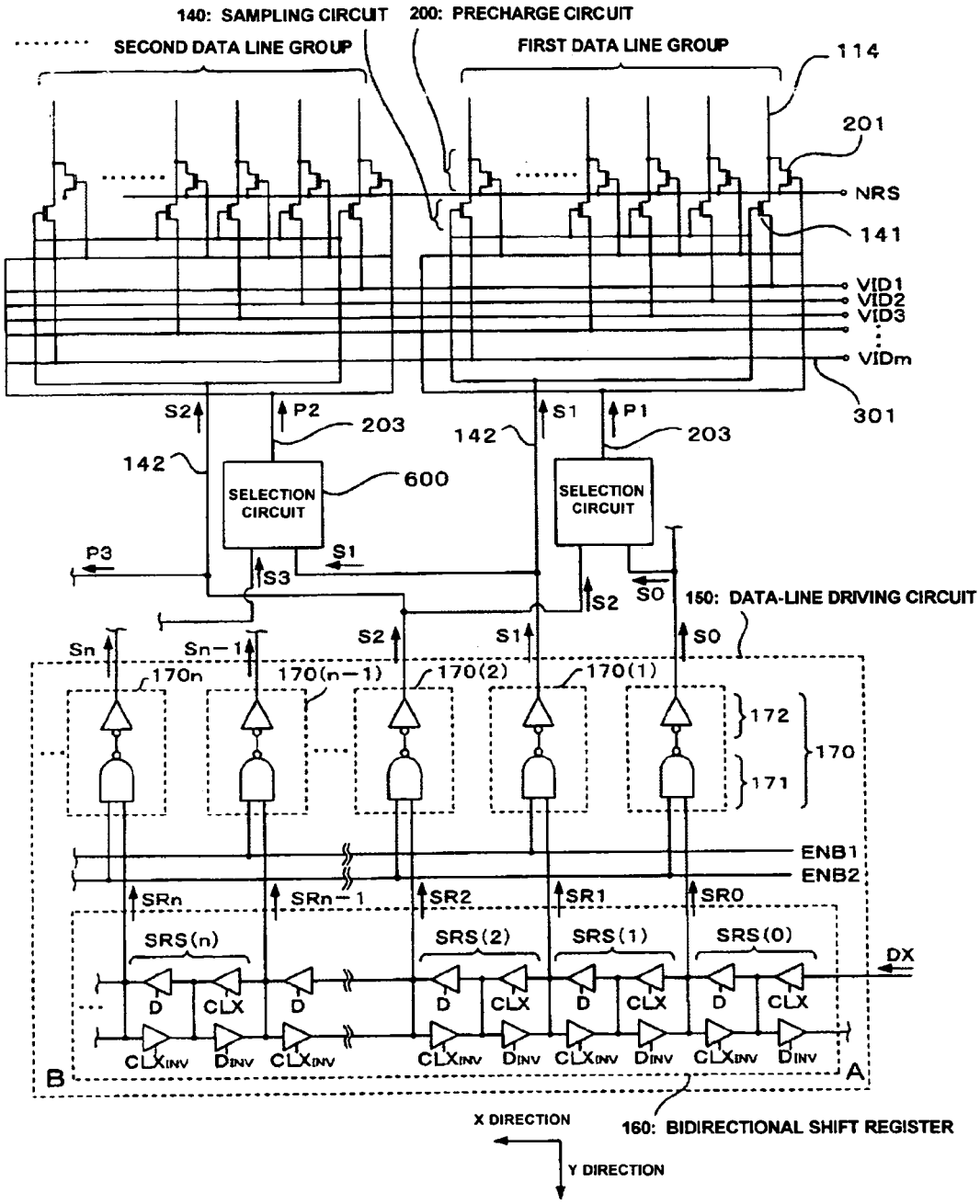
FIG. 8 is a circuit schematic illustrating details of a sampling circuit, a data-line driving circuit, and a precharge circuit according to a third exemplary embodiment.
Figure 9:
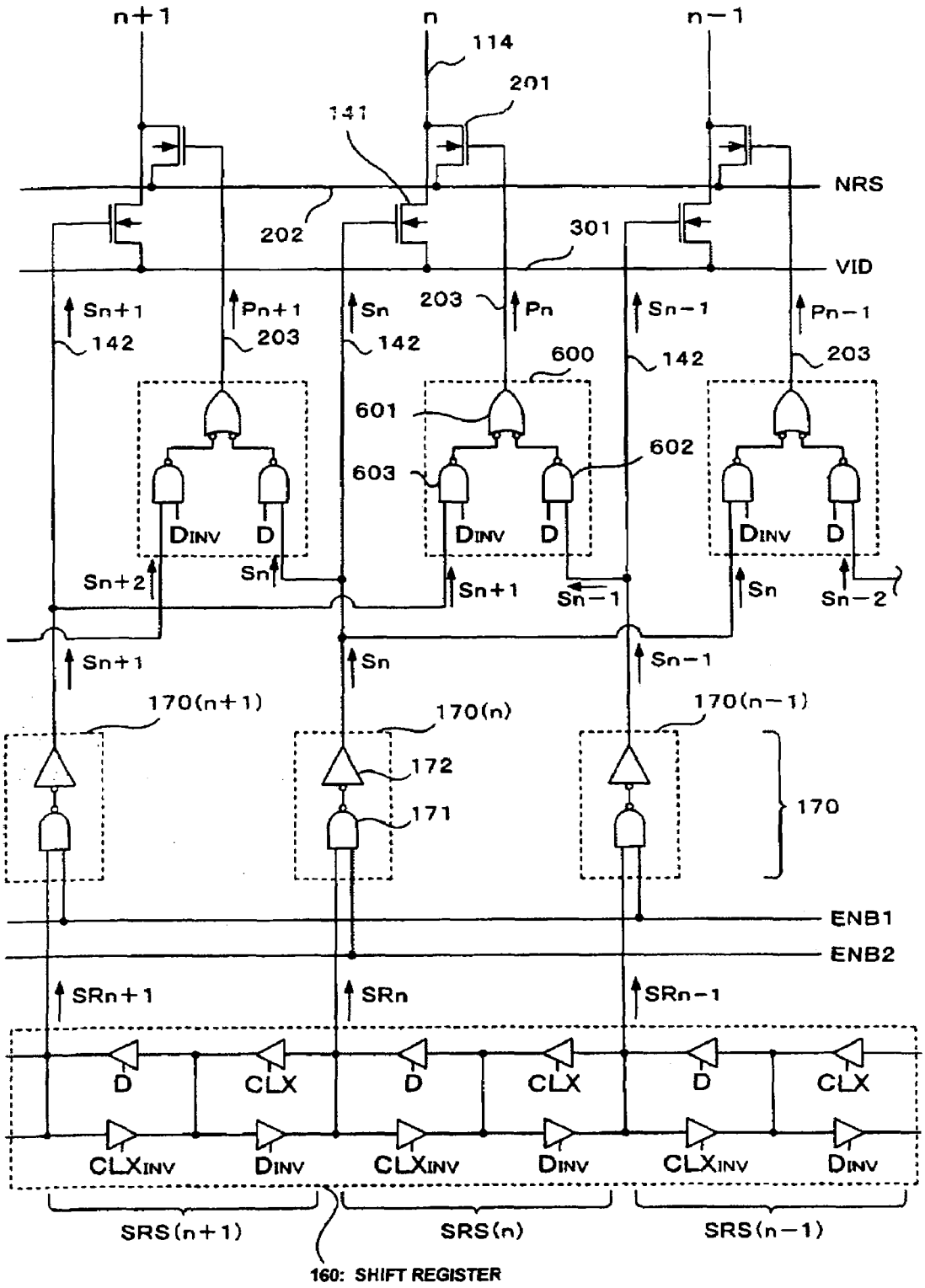
FIG. 9 is a circuit schematic illustrating a construction of the precharge circuit according to the third exemplary embodiment, where a part of the precharge circuit corresponding to a (n−1)-th data line group, a n-th data line group, and a (n+1)-th data line group is extracted and illustrated.

Now, a third exemplary embodiment of the electro-optical device according to the present invention will be described with reference to FIGS. 8 and 9. FIG. 8 is a circuit schematic illustrating constructions of the sampling circuit, the data-line driving circuit, and the precharge circuit according to this exemplary embodiment. FIG. 9 is a circuit schematic illustrating a construction of the precharge circuit 200 according to this exemplary embodiment, where a part of the precharge circuit corresponding to a (n−1)-th data line group, a n-th data line group, and a (n+1)-th data line group is extracted and illustrated.

The third exemplary embodiment is different from the aforementioned first exemplary embodiment in a circuit construction of the shift register circuit in the data-line driving circuit, and connections of the sampling-circuit driving signal lines and the precharge-circuit driving signal lines. Since the elements in the liquid crystal panel 100 are similar, the whole construction of the liquid crystal display device shown in FIG. 1 will be not shown. The connections of the respective signal lines in the driving circuit 120 different from those of the first exemplary embodiment in FIG. 1 are illustrated in FIGS. 8 and 9. Hereinafter, the constructions different from those of the first exemplary embodiment will be described. The elements common to those of the first exemplary embodiment are denoted by the same reference numerals, and descriptions thereof will be omitted.

In this exemplary embodiment, as shown in FIG. 8, the data-line driving circuit 150 employs a "bi-directional shift register" as the shift register. The shift register 160 is shown in FIG. 8. But the shift register can be switched between a function as a shift register to shift signals in a A-B direction and a function as a shift register to shift signals in a B-A direction by switching a start pulse DX, etc. It is a so-called "bi-directional shift register".

In the bi-directional shift register 160, as shown in FIG. 8, the shift register elements include only clocked inverters. Clocked inverters to control the transmission direction are connected in series to a clocked inverter as a signal receiving section and a clocked inverter as a signal feedback section. The transmission-direction control signal D and the inverted signal $D_{INV}$ thereof are input to the gate terminals of the clocked inverters to control the transmission direction. When the transmission-direction control signal D is at a high level, the signals are transmitted in the A-B direction in FIG. 8, and when the inverted signal $D_{INV}$ is at a high level, the signals are transmitted in the B-A direction.

The basic operation of the bi-directional shift register is similar to the shift register of the first exemplary embodiment. When the signals are transmitted in the A-B direction in FIG. 8, the transmission signals are output sequentially in the order of SR1, SR2, . . . . When the signals are transmitted in the B-A direction, the transmission signals are output sequentially in the order of SRn, SRn−1 . . . .

In this exemplary embodiment, similar to the first exemplary embodiment, the precharge-circuit driving signal corresponding to one data line group is supplied using the sampling signal corresponding to another data line group to which the image signal is written prior to the one data line group. However, in this exemplary embodiment, since the "bi-directional shift register" is employed, in order to supply the precharge-circuit driving signal Pn to the precharge circuit corresponding to the n-th data line group, it is selected in accordance with the transmission direction of the shift register whether the sampling signal Sn−1 is used or the sampling signal Sn+1 is used.

When the transmission direction is the X direction shown in FIG. 2 and the transmission signals are output in the order of SR1, SR2, . . . , Sn−1, Sn, . . . , the sampling signal Sn−1 corresponding to the (n−1)-th data line group is supplied as the precharge-circuit driving signal Pn. When the transmission direction is inverted and the transmission signals are output in the order of SRn+1, SRn, SRn−1, . . . , the sampling signal Sn+1 corresponding to the (n+1)-th data line group is supplied as the precharge-circuit driving signal Pn.

Therefore, in this exemplary embodiment, a "selection circuit" to select the input signal to the precharge-circuit driving signal lines is provided, which will be described hereinafter.

As shown in FIG. 8, the selection circuit 600 is provided in an area between the sampling circuit 140 and the data-line driving circuit 150. Now, specifically, a detailed construction of a part of the selection circuit 600 corresponding to the (n−1)-th, n-th and (n+1)-th data line group will be described with reference to FIG. 9.

As shown in FIG. 9, the selection circuit 600 is provided between the (n−1)-th sampling-circuit driving signal line 142 and the n-th sampling-circuit driving signal line 142. The selection circuit 600 includes an equivalent circuit 601 (hereinafter, "NAND circuit") of the NAND circuit shown as a negative logic circuit and NAND circuits 602 and 603. The NAND circuit 601 is connected to the gate electrode of the precharge switch 201. The transmission-direction control signal D is input to one input terminal of the NAND circuit 602. The other input terminal thereof is connected to the sampling-circuit driving signal line 142 corresponding to the (n−1)-th data line group. The inverted signal $D_{INV}$ of the transmission-direction control signal is input to one input terminal of the NAND circuit 603. The other input terminal thereof is connected to the sampling-circuit driving signal line 142 corresponding to the (n+1)-th data line group.

According to this construction, regarding the n-th data line group, in a case where the transmission direction of the bidirectional shift register 160 is the A-B direction (a case where the transmission-direction control signal D is at "ON (a high level)" and the inverted signal $D_{INV}$ is at "OFF a low level)"), the precharge-circuit driving signal Pn becomes "ON" only when the sampling signal Sn−1 is at "ON". In a case where the transmission direction of the bi-directional shift register 160 is the B-A direction (a case where the transmission-direction control signal D is at "OFF" and the inverted signal $D_{INV}$ is at "ON"), the precharge-circuit driving signal Pn becomes "ON" only when the sampling signal Sn+1 is at "ON". One of the sampling signals Sn−1 and Sn is selected as the precharge-circuit driving signal Pn in accordance with the transmission direction and input to the precharge circuit.

In this way, since a signal which is a base of the precharge-circuit driving signal input to the precharge circuit is selected in accordance with the transmission direction of the bi-directional shift register 160, the same sequential precharge as the first embodiment can be implemented in any transmission direction.

This exemplary embodiment is different from the first exemplary embodiment in that the "bi-directional shift register" is used and the input of the precharge-circuit driving signal is selected in accordance with the transmission direction thereof. But the operation and operational effects of the precharge circuit and the enable circuit are similar to those of the first exemplary embodiment. Therefore, the advantage obtained from the sequential precharge accomplished through the construction and operation described above is similar to that of the first exemplary embodiment.

Fourth Exemplary Embodiment

Figure 10:
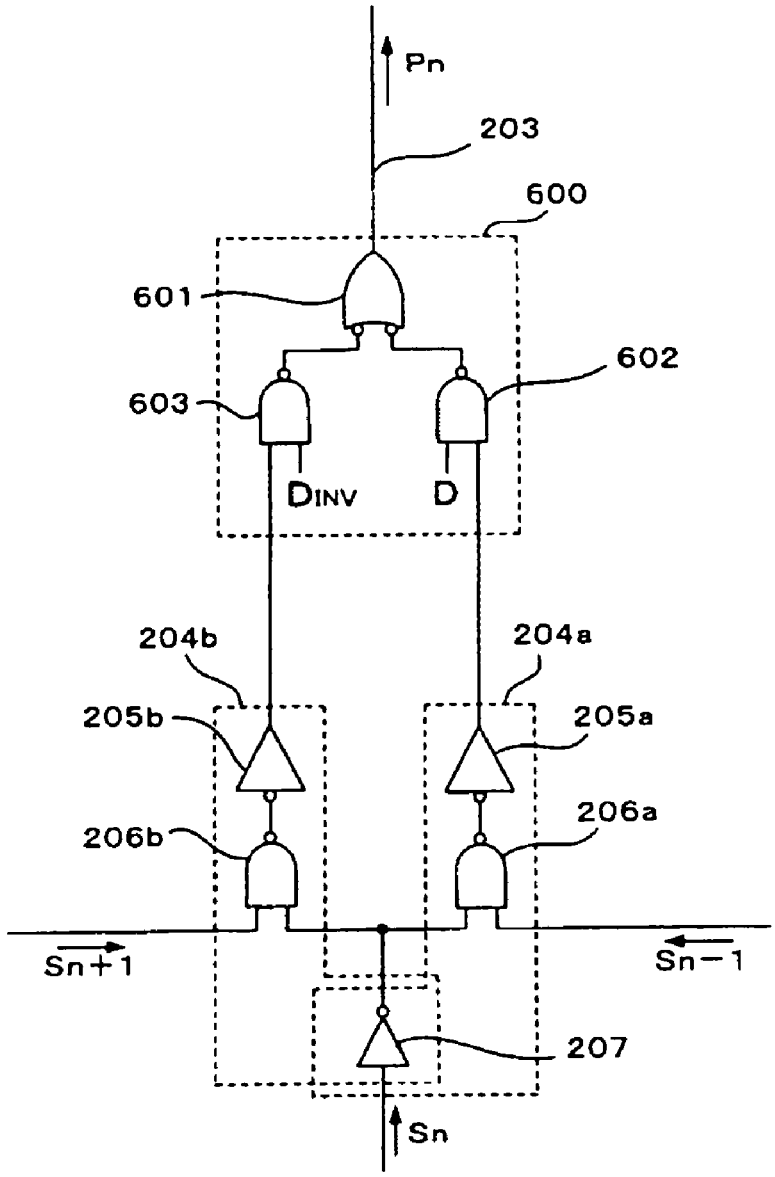
FIG. 10 is a circuit schematic illustrating connections of a trimming circuit and a selection circuit according to a fourth exemplary embodiment.

Now, a fourth exemplary embodiment of the electro-optical device according to the present invention will be described with reference to FIG. 10. FIG. 10 is a circuit schematic illustrating connections of the trimming circuit 204 and the selection circuit 600 similar to the second exemplary embodiment and the third exemplary embodiment.

The fourth exemplary embodiment is different from the aforementioned third exemplary embodiment in a circuit construction between the adjacent sampling-circuit driving signal lines and in a method of supplying the precharge-circuit driving signals. The circuit constructions and operation of the shift register circuit and the enable circuit, and the whole construction of the liquid crystal display device are similar to those of the third exemplary embodiment. Hereinafter, the constructions different from the third exemplary embodiment will be described. The elements common to the third exemplary embodiment are denoted by the same reference numerals, and descriptions thereof will be omitted.

In this exemplary embodiment, specifically, in addition to the construction of the data-line driving circuit including the "bi-directional shift register" of the third exemplary embodiment, the "trimming device" of the second exemplary embodiment is further provided.

Now, a method of supplying the precharge-circuit driving signal Pn to the n-th data line group will be described with reference to FIG. 10.

As shown in FIG. 10, a trimming circuit 204*a* is connected to one input terminal of a NAND circuit 602 in the selection circuit 600. The transmission-direction control signal D is input to the other input terminal. Similarly, a trimming circuit 204*b* is connected to one input terminal of a NAND circuit 603, and the inverted signal $D_{INV}$ thereof is input to the other input terminal. Here, the two trimming circuits 204 share the inverter 207 which is a constituent element thereof. The trimming circuit 204*a*, 204*b* include inverter 205*a*, 205*b* and NAND circuit 206*a*,206*b*. In a NAND circuit 206*a* of the trimming circuit 204*a*, the sampling signal Sn−1 corresponding to the (n−1)-th data line group is input to one input terminal thereof, and the inverted signal of the sampling signal Sn corresponding to the n-th data line group is input to the other input terminal. In a NAND circuit 206*b* of the trimming circuit 204*b*, the sampling signal Sn+1 corresponding to the (n+1)-th data line group is input to one input terminal. The inverted signal of the sampling signal Sn is similarly input to the other input terminal.

According to this construction, it is possible to implement the sequential precharge employing the "bi-directional shift register" similar to that of the third exemplary embodiment and including the "trimming device" similar to that of the second exemplary embodiment.

This exemplary embodiment is different from the first exemplary embodiment in that the "bi-directional shift register" is provided in the data-line driving circuit, and the operation and operational effects of the precharge circuit and the enable circuit are similar to those of the first exemplary embodiment. Therefore, the advantage obtained from the sequential precharge accomplished through the construction and operation described above is similar to that of the first exemplary embodiment.

Construction of Liquid Crystal Display Device

The construction of the liquid crystal display device according to the first to fourth exemplary embodiments of the present invention constructed as described above will be described with reference to FIGS. 11 and 12. Here, FIG. 11 is a schematic of the TFT array substrate 10 with the elements formed thereon as seen from the counter substrate 20 side, and FIG. 12 is a cross-sectional schematic taken along plane H-H' of FIG. 11.

Figure 11:
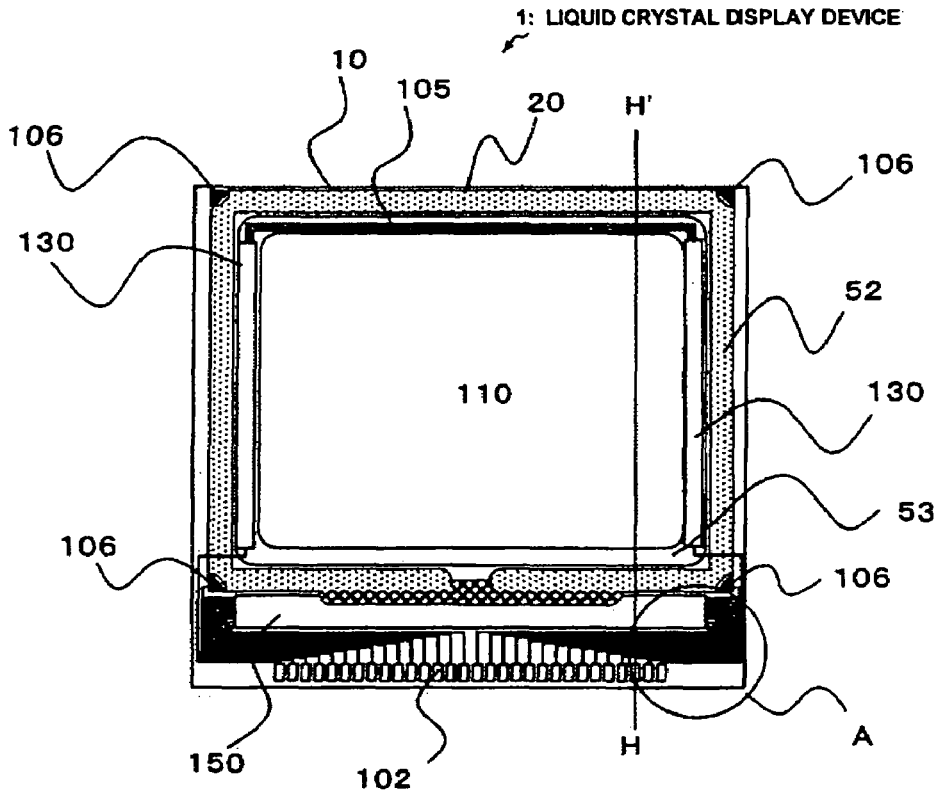
FIG. 11 is a schematic illustrating a whole construction of a liquid crystal display device.
Figure 12:
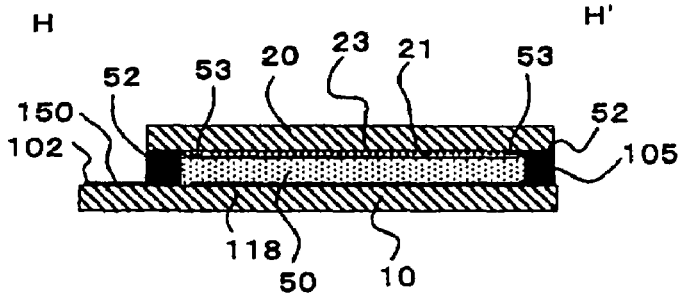
FIG. 12 is a cross-sectional schematic taken along plane H-H' of FIG. 11.

In FIGS. 11 and 12, on the TFT array substrate 10, a seal member 52, made of photo-curable resin which bonds both substrates around the image display area (an area of the liquid crystal display device in which the images are practically displayed by variation in alignment condition of the liquid crystal layer 50) defined by a plurality of pixel electrodes 118 and surrounds the liquid crystal layer 50, is provided along the image display area. The counter substrate 20 has a counter electrode 21. A frame-shaped light-shielding film 53 is provided between the image display area and the seal member 52 on the counter substrate 20. The frame-shaped light-shielding film 53 or a light-shielding layer 23 may be formed on the TFT array substrate 10.

The scanning-line driving circuit 130 is provided in portions along two right-and-left sides of the image display area 110. Here, in a case where driving delay of the scanning lines 112 causes no problem, the scanning-line driving circuit 130 may be formed only at one side of the scanning lines 112.

In an outer area of the seal member 52, the data-line driving circuit 150 and external circuit connection terminals 102 to input signals externally are provided along a lower side of the image display area. The scanning-line driving circuit 130 is provided at both ends of the image display area along two right-and-left sides of the image display area. Here, the data-line driving circuit 150 may be provided at both ends along two top-and-bottom sides of the image display area. At that time, by electrically connecting odd columns of data lines to one data-line driving circuit 150 and electrically connecting even columns of data lines to the other data-line driving circuit 150, the data lines may be driven from up and down in a dovetailed shape. In the upper side of the image display area, a plurality of wires 105 to supply a power source or driving signals to the scanning-line driving circuit 130 are provided. A vertical connection member 106 to provide electrical connection between the TFT array substrate 10 and the counter substrate 20 is provided in at least one of the corner portions of the counter substrate 20. The counter substrate 20 having a profile substantially equal to the seal member 52 is fixed to the TFT array substrate 10 through the seal member 52.

In the exemplary embodiments described above, a case where the external control circuit to output clock signals, image signals, or the like to the data-line driving circuit 150 and the scanning-line driving circuit 130 is provided outside the liquid crystal display device has been explained. However, the present invention is not limited to this, and the control circuit may be provided in the liquid crystal display device.

Specifically, regarding the clock signals, a circuit to allow only clock signals to be supplied externally and generating inverted clock signals may be provided on the substrate for the liquid crystal display device.

The liquid crystal display device described above can be applied to a color liquid crystal projector, etc. In this case, three liquid crystal display devices are used as light valves for R, G, and B, respectively. The respective color light components decomposed through a dichroic mirror for RGB color decomposition are input as incident light components to the respective panels. Therefore, in the exemplary embodiments, a color filter is not provided on the counter substrate 20. However, the RGB color filters together with protective films thereof may be formed in predetermined areas on the counter substrate 20 corresponding to pixel electrodes 11 on which the light-shielding layers 23 are not formed in the liquid crystal display device. Accordingly, the liquid crystal display device according to this exemplary embodiment can be applied to a color liquid crystal display apparatus, such as a direct view-type or reflection-type color crystal liquid television, etc. in addition to the liquid crystal projector.

The switching elements used for the liquid crystal display device may be positively-staggered or coplanar type poly silicon TFTs, and this exemplary embodiment can be effective in other types of TFTs, such as inversely staggered TFTs or amorphous silicon TFTs.

In the liquid crystal display device, the liquid crystal layer 50 is made of, for example, nematic liquid crystal, but by employing polymer dispersed liquid crystal in which fine particles of liquid crystal are dispersed in polymer, the alignment film and the aforementioned polarizing film, the polarizing plate, etc. become unnecessary, so that it is possible to obtain advantages, such as high brightness or low power consumption of the liquid crystal display device due to enhancement of light efficiency.

In place of providing the data-line driving circuit 150 and the scanning-line driving circuit 130 on the TFT array substrate 10, the data-line driving circuit and the scanning-line driving circuit may be, for example, electrically and mechanically connected to a driving LSI mounted on a TAB (Tape Automated Bonding substrate) through an anisotropic conductive film provided in the peripheral areas of the TFT array substrate 10.

In the aforementioned exemplary embodiments, a construction of the scanning-line driving circuit 130 has not been described in detail, but specifically, a shift register section thereof may be constructed similarly to that of the data-line driving circuit 150.

Electronic Apparatus

Next, exemplary embodiments of an electronic apparatus including the liquid crystal display device 1 described above in detail will be described with reference to FIGS. 13 through 16.

Figure 13:
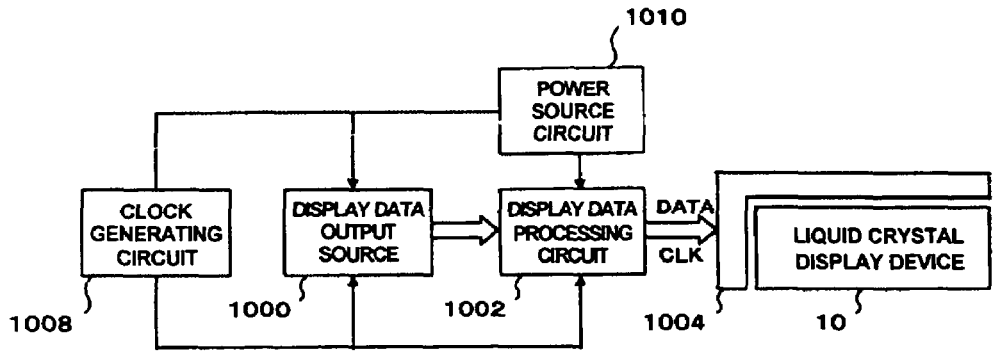
FIG. 13 is a schematic illustrating a construction of an electronic apparatus according to an exemplary embodiment of the present invention.

First, a schematic construction of such electronic apparatus including the liquid crystal display device 1 is shown in FIG. 13.

In FIG. 13, the electronic apparatus includes a display data output source 1000, the aforementioned external display data processing circuit 1002, a display driving circuit 1004 having the scanning-line driving circuit 130 and the data-line driving circuit 150 described above, the liquid crystal display device 1, a clock generating circuit 1008, and a power source circuit 1010. The display data output source 1000 includes a memory, such as a ROM (Read Only Memory), a RAM (Random Access Memory) and an optical disk device, a resonator circuit to synchronize and output television signals, etc., and outputs display data, such as image signals of a predetermined format to the display data processing circuit 1002 on the basis of the clock signal from the clock generating circuit 1008. The display data processing circuit 1002 includes various related art processing circuits, such as an amplifying and polarity inverting circuit, a phase developing circuit, a rotation circuit, a gamma correction circuit, a clamp circuit, etc., and sequentially generates digital signals from the display data input on the basis of the clock signal from the clock generating circuit 1008 to output the digital signals together with the clock signal CLK to the display driving circuit 1004. The display driving circuit 1004 drives the liquid crystal display device 1 through the scanning-line driving circuit 130 and the data-line driving circuit 150 by using the aforementioned driving method. The power source circuit 1010 supplies a predetermined power to the respective circuits described above. On the substrate for the liquid crystal display device constituting the liquid crystal display device 1, the display driving circuit 1004 may be mounted. In addition to the display driving circuit, the display data processing circuit 1002 may be mounted.

Figure 14:
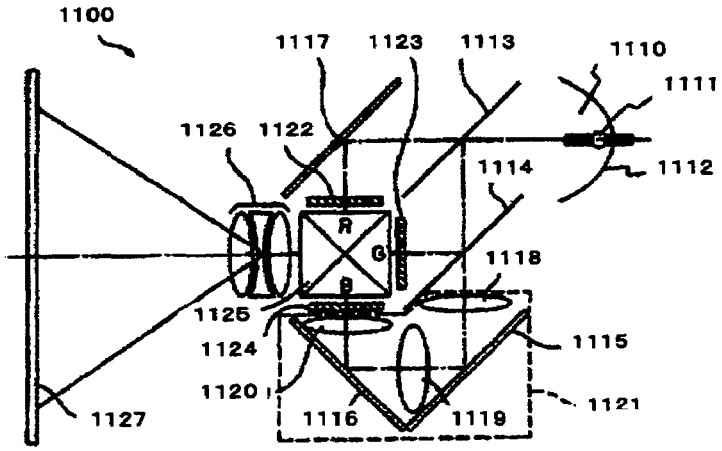
FIG. 14 is a cross-sectional schematic illustrating a liquid crystal projector as an example of the electronic apparatus.
Figure 15:
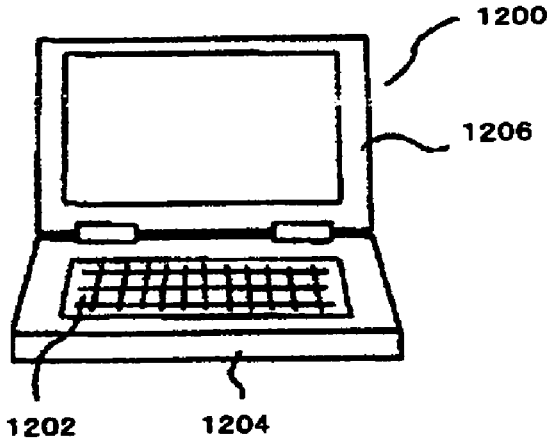
FIG. 15 is a schematic illustrating a personal computer as another example of the electronic apparatus.

Examples of the electronic apparatus having such construction may include the liquid crystal projector shown in FIG. 14, a personal computer (PC) and an engineering work station (EWS) corresponding to the multi media shown in FIG. 15, a mobile phone, a word processor, a television, a view finder type or monitor direct view-type video tape recorder, an electronic pocket book, an electronic desktop calculator, a car navigation apparatus, a POS terminal, an apparatus having a touch panel, and the like.

Figure 16:
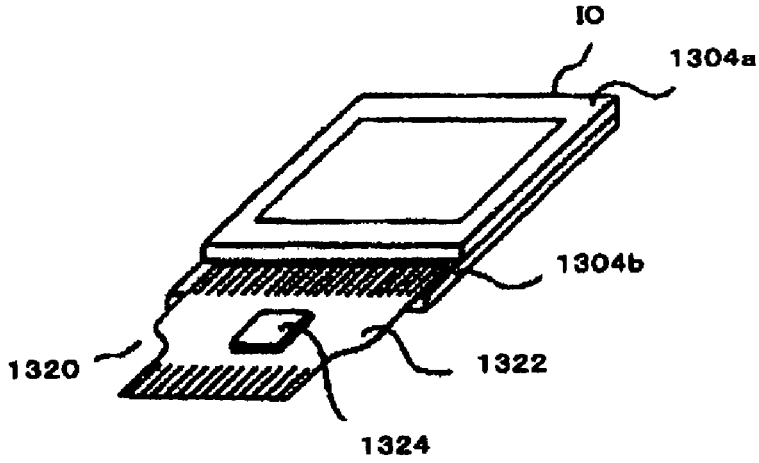
FIG. 16 is a schematic illustrating a liquid crystal display apparatus employing a TCP as another example of the electronic apparatus.

Next, specific examples of the electronic apparatus having such construction are shown in FIGS. 14 to 16, respectively.

In FIG. 14, a liquid crystal projector 1100 as an example of the electronic apparatus is a projection type liquid crystal projector, and includes a light source 1110, dichroic mirrors 1113, 1114, reflecting mirrors 1115, 1116, 1117, an entrance lens 1118, a relay lens 1119, an exit lens 1120, liquid crystal light valves 1122, 1123, 1124, a cross dichroic prism 1125, and a projection lens 1126. Three liquid crystal display modules, each of which include the liquid crystal display device 1 in which the aforementioned driving circuit 1004 is mounted on a substrate for the liquid crystal display device, are used as the liquid crystal light valves 1122, 1123, 1124, respectively. The light source 1110 includes a lamp 1111 of metal halide, etc. and a reflector 1112 to reflect the light of the lamp 1111.

In the liquid crystal projector 1100 constructed as described above, the dichroic mirror 1113 to reflect the blue light component and the green light component transmits the red light component in the flux of white light from a light source 1110 and reflects the blue light component and the green light component. The transmitted red light component is reflected by the reflecting mirror 1117 and is input to the liquid crystal light valve 1122 for a red light component. The green light component of the color light components reflected by the dichroic mirror 1113 is reflected by the dichroic mirror 1114 to reflect a green light component and is input to the liquid crystal light valve 1123 for a green light component. The blue light component passes through the second dichroic mirror 1114. Regarding the blue light component, light guiding device 1121 having a relay lens system including the entrance lens 1118, the relay lens 1119, and the exit lens 1120 is provided to reduce or prevent light loss through a long light path. The blue light component enters the liquid crystal light valve 1124 for a blue light component through the light guiding device. Three color light components modulated by the respective light valves enter a cross dichroic prism 1125. In this prism, four right angle prisms are bonded, and a dielectric multilayer film to reflect the red light component and a dielectric multilayer film to reflect the blue light component are formed in a cross shape therein. Three color light components are composed by the dielectric multilayer films, thereby forming light representing a color image. The composed light is projected, enlarged and displayed onto a screen 1127 through the projection lens 1126 which is a projection optical system.

In FIG. 15, a laptop type personal computer 1200 as another example of the electronic apparatus includes a liquid crystal display 1206 in which the aforementioned liquid crystal display device 1 is provided in a top cover case. A main body 1204 which houses a CPU, a memory, a modem, etc. and is provided with a keyboard 1202.

As shown in FIG. 16, one of two transparent substrates 1304*a*, 1304*b* constituting a substrate 1304 for a liquid crystal display device is connected to a TCP (Tape Carrier Package) 1320 in which an IC chip 1324 is mounted on a polyimide tape 1322 provided with a metal conductive film. As a result, a liquid crystal display device as a part of an electronic apparatus can be produced, sold, and utilized.

In addition to the electronic apparatus described above with reference to FIGS. 14 to 16, examples of the electronic apparatus shown in FIG. 13 may include a liquid crystal television, a view finder type or monitor direct view-type video tape recorder, a car navigation apparatus, an electronic pocket book, a calculator, a word processor, a work station, a mobile phone, a television phone, a POS terminal, an apparatus having a touch panel and the like.

The present invention is not limited to the aforementioned exemplary embodiments, but may be properly changed without departing from the gist or spirit of the present invention understood from the scope of claims and the whole specification. A driving circuit for an electro-optical panel having been changed in this way, and an electro-optical device and an electronic apparatus including the driving circuit for an electro-optical panel also belong to the technical scope of the present invention.

What is claimed is:

1. A driving circuit for an electro-optical panel, including:

a substrate;

pixel electrodes formed on the substrate;

switching elements to switch and control the pixel electrodes;

data lines to supply an image signal to the pixel electrodes through the switching elements;

a data-line driving circuit including a shift register circuit that sequentially outputs transmission signals;

a sampling circuit that samples the image signal using a sequentially-output n-th (n is a natural number greater than or equal to 2) transmission signal as a sampling-circuit driving signal, and writes the sampled image signals to the data lines;

a precharge circuit that writes a precharge signal of a predetermined potential to the data lines using the sequentially-output (n−1)-th transmission signal as a precharge-circuit driving signal prior to supplying the image signal to the data lines; and a period when the precharge signal is written to the data lines in response to the (n−1)-th transmission signal and a period when the image signal is written to the data lines in response to the n-th transmission signal not overlapping with each other on the time axis.

2. The driving circuit for an electro-optical panel according to claim 1, the data-line driving circuit, the sampling circuit and the precharge circuit arranged at one end of the data lines on the substrate, and the image signal and the precharge signal written to the data lines from the one end of the data lines.

3. The driving circuit for an electro-optical panel according to claim 2, the shift register circuit being a bi-directional shift register circuit, a transmission direction in which the transmission signals are transmitted from a plurality of output terminals of the shift register circuit controlled on the basis of a transmission-direction control signal from a common direction control signal section, and the driving circuit including a selection circuit to select a supply source of the precharge-circuit driving signal in accordance with the transmission direction.

4. The driving circuit for an electro-optical panel according to claim 3, the selection circuit selects one transmission signal preceding the n-th transmission signal from the (n+1)-th transmission signal and the (n−1)-th transmission signal as the precharge-circuit driving signal on the basis of the transmission-direction control signal.

5. The driving circuit for an electro-optical panel according to claim 1, a period when the image signal is written to one data line in response to the n-th transmission signal and a period when the precharge signal is written to another data line, to which the image signal is written after the one data line, in response to the n-th transmission signal overlapping at least partially with each other on the time axis.

6. The driving circuit for an electro-optical panel according to claim 1, the data-line driving circuit includes an enable device to restrict a period when the transmission signals become a trigger level, such that a period when the precharge signal is written to the same data line and a period when the image signal is written to the same data line not overlapping with each other.

7. The driving circuit for an electro-optical panel according to claim 6, the enable device restricting the period when the transmission signals become a trigger level, on the basis of enable pulses which are supplied externally, the enable pulses adjacent to each other not overlapping with each other.

8. The driving circuit for an electro-optical panel according to claim 1, a trimming device to restrict a period when the transmission signals become a trigger level further provided between the precharge circuit and the sampling circuit, such that a period when the precharge signal is written to the same data line and a period when the image signal is written to the same data line not overlapping with each other.

9. The driving circuit for an electro-optical panel according to claim 8, the trimming device restricts the period when the precharge signal becomes a trigger level by trimming the precharge signal, which is output from the precharge circuit in response to the (n−1)-th transmission signal, in response to the n-th transmission signal in the precharge circuit and the sampling circuit connected to the same data line.

10. An electro-optical device, comprising;

the driving circuit for an electro-optical panel according to claim 1, and an electro-optical panel to be driven by the driving circuit.

11. An electronic apparatus, comprising:

the electro-optical device according to claim 10.

12. A driving circuit for an electro-optical panel, including:

a substrate;

pixel electrodes formed on the substrate;

switching elements to switch and control the pixel electrodes; data lines to supply an image signal to the pixel electrodes through the switching elements;

a data-line driving circuit including a shift register circuit that sequentially outputs transmission signals;

a sampling circuit that samples the image signal using a sequentially-output n-th (n is a natural number greater than or equal to 2) transmission signal as a sampling-circuit driving signal, and writes the sampled image signals to the data lines;

a precharge circuit that writes a precharge signal of a predetermined potential to the data lines using the sequentially-output (n−1)-th transmission signal as a precharge-circuit driving signal prior to supplying the image signal to the data lines; and a period when the precharge signal is written to the data lines in response to the (n−1)-th transmission signal and a period when the image signal is written to the data lines in response to the n-th transmission signal do not overlap with each other on the time axis;

the image signal being serial-to-parallel converted into m phase signals (m is a natural number greater than or equal to 2), the data lines being classified into simultaneously-driven data line groups which include m data lines and which the same transmission signal is simultaneously written to, and a period when the precharge signal is written to the simultaneously-driven data line group, which the image signal is written to in response to the n-th transmission signal, in response to the (n−1)-th transmission signal and a period when the image signal is written to the simultaneously-driven data line group in response to the n-th transmission signal not overlapping with each other on the time axis.

13. The driving circuit for an electro-optical panel according to claim 12, a period when the precharge signal is written to the simultaneously-driven data line group, which the image signal is written to in response to the n-th transmission signal, in response to the (n−1)-th transmission signal and a period when the image signal is written to the simultaneously-driven data line group, which the image signal is written to in response to the (n−1)-th transmission signal, in response to the (n−1)transmission signal overlapping at least partially with each other on the time axis.

* * * * *